US011499420B2

(12) United States Patent
Peters et al.

(10) Patent No.: US 11,499,420 B2
(45) Date of Patent: Nov. 15, 2022

(54) OSCILLATING SHEAR VALVE FOR MUD PULSE TELEMETRY AND OPERATION THEREOF

(71) Applicant: Baker Hughes Oilfield Operations LLC, Houston, TX (US)

(72) Inventors: Volker Peters, Niedersachsen (DE); Detlef Hahn, Hannover LS (DE); Heiko Eggers, Bad Fallingbostel (DE); Heige Brand, Niedersachsen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/126,984

(22) Filed: Dec. 18, 2020

(65) Prior Publication Data

US 2021/0189873 A1 Jun. 24, 2021

Related U.S. Application Data

(60) Provisional application No. 62/949,731, filed on Dec. 18, 2019.

(51) Int. Cl.
*E21B 47/18* (2012.01)
*E21B 47/20* (2012.01)

(52) U.S. Cl.
CPC ..... *E21B 47/18* (2013.01)

(58) Field of Classification Search
None
See application file for complete search history.

(56) References Cited

U.S. PATENT DOCUMENTS 2,911,192 A 11/1959 Boucher
2,964,116 A 12/1960 Peterson
(Continued)

FOREIGN PATENT DOCUMENTS

CA 2952649 C * 7/2018 ..... E21B 47/18
EP 0140788 A2 5/1985
(Continued)

OTHER PUBLICATIONS

Carter, Joseph Alan; "Experimental and Theoretical Study of Mud Pulse Propagation: A Thesis"; Graduate Faculty of the Lousiana State University and Agricultural and Mechanical College Department of Petroleum Engineering; May 1986; 74 Pages.
(Continued)

*Primary Examiner* — Curtis A Kuntz
*Assistant Examiner* — Jerold B Murphy
(74) *Attorney, Agent, or Firm* — Cantor Colburn LLP

(57) ABSTRACT

Methods and systems for generating pulses in drilling fluid are described. The methods include driving rotation of a rotor relative to a stator of a pulser assembly in an oscillatory manner. The oscillatory manner includes rotating an obstructing element from a middle position to a first blocking angle position and rotating the obstructing element from the first blocking angle position to a second blocking angle position such that selective obstruction occurs. Rotation of the at least one obstructing element selectively obstructs a stator flow passage when drilling fluid is flowing through the drill string to generate a pressure pulse in the drilling fluid and the oscillatory manner is an oscillation of the obstructing element between the first blocking angle position and the second blocking angle position such that a single oscillation is between two obstructed states of the stator flow passage.

24 Claims, 20 Drawing Sheets

(56) References Cited

U.S. PATENT DOCUMENTS

| | | | | |
|---|---|---|---|---|
| 2,973,505 | A | 2/1961 | Johannesen | |
| 3,065,416 | A | 11/1962 | Jeter | |
| 3,302,457 | A | 2/1967 | Mayes | |
| 3,309,656 | A | 3/1967 | Godbey | |
| 3,507,341 | A | 4/1970 | Basgan | |
| 3,693,428 | A | 9/1972 | Le Peuvedic et al. | |
| 3,713,089 | A | 1/1973 | Clacomb | |
| 3,723,728 | A | 3/1973 | Von Hayn | |
| 3,736,558 | A | 5/1973 | Cubberly, Jr. | |
| 3,764,968 | A * | 10/1973 | Anderson | E21B 47/18 367/84 |
| 3,958,217 | A | 5/1976 | Spinnler | |
| 3,983,948 | A | 10/1976 | Jeter | |
| 4,351,037 | A * | 9/1982 | Scherbatskoy | E21B 47/017 33/307 |
| 4,491,738 | A | 1/1985 | Kamp | |
| 4,643,654 | A | 2/1987 | Rinder | |
| 4,785,300 | A | 11/1988 | Chin et al. | |
| 4,847,815 | A | 7/1989 | Malone | |
| 4,903,245 | A | 2/1990 | Close et al. | |
| 4,914,637 | A | 4/1990 | Goodsman | |
| 4,953,595 | A | 9/1990 | Kotlyar | |
| 5,073,877 | A | 12/1991 | Jeter | |
| 5,106,263 | A | 4/1992 | Irie | |
| 5,117,398 | A | 5/1992 | Jeter | |
| 5,119,344 | A | 6/1992 | Innes | |
| 5,182,731 | A | 1/1993 | Hoelscher | |
| 5,189,645 | A | 2/1993 | Innes | |
| 5,215,152 | A | 6/1993 | Duckworth | |
| 5,249,161 | A | 9/1993 | Jones et al. | |
| 5,311,952 | A | 5/1994 | Eddison et al. | |
| 5,357,483 | A | 10/1994 | Innes | |
| 5,375,098 | A | 12/1994 | Malone et al. | |
| 5,473,579 | A | 12/1995 | Jeter | |
| 5,477,923 | A | 12/1995 | Jordan, Jr. et al. | |
| 5,517,464 | A | 5/1996 | Lerner et al. | |
| 5,546,359 | A | 8/1996 | Aarseth | |
| 5,586,083 | A | 12/1996 | Chin et al. | |
| 5,636,178 | A | 6/1997 | Ritter | |
| 5,660,238 | A | 8/1997 | Earl et al. | |
| 5,740,126 | A | 4/1998 | Chin et al. | |
| 5,787,052 | A | 7/1998 | Gardner et al. | |
| 5,812,068 | A | 9/1998 | Wisler et al. | |
| 5,957,220 | A | 9/1999 | Coffman et al. | |
| 5,963,138 | A | 10/1999 | Gruenhagen | |
| 6,016,288 | A | 1/2000 | Frith | |
| 6,050,348 | A | 4/2000 | Richardson et al. | |
| 6,097,310 | A | 8/2000 | Harrell et al. | |
| 6,219,301 | B1 | 4/2001 | Moriarty | |
| 6,250,880 | B1 | 6/2001 | Woodard et al. | |
| 6,469,637 | B1 | 10/2002 | Seyler et al. | |
| 6,484,817 | B2 | 11/2002 | Innes | |
| 6,555,926 | B2 | 4/2003 | Gondron | |
| 6,577,244 | B1 | 6/2003 | Clark et al. | |
| 6,623,475 | B1 | 9/2003 | Siess | |
| 6,626,253 | B2 | 9/2003 | Hahn et al. | |
| 6,714,138 | B1 | 3/2004 | Turner et al. | |
| 6,836,218 | B2 | 12/2004 | Frey et al. | |
| 6,896,050 | B2 | 5/2005 | Biglin, Jr. et al. | |
| 6,903,660 | B2 | 6/2005 | Clark et al. | |
| 6,970,398 | B2 | 11/2005 | Lavrut et al. | |
| 6,975,243 | B2 | 12/2005 | Clark et al. | |
| 6,975,244 | B2 | 12/2005 | Hahn et al. | |
| 6,995,684 | B2 | 2/2006 | Clark | |
| 7,011,156 | B2 | 3/2006 | Von Gynz-Rekowski | |
| 7,083,008 | B2 | 8/2006 | Thorp et al. | |
| 7,133,325 | B2 | 11/2006 | Kotsonis et al. | |
| 7,187,297 | B2 | 3/2007 | Clark et al. | |
| 7,230,880 | B2 | 6/2007 | Lehr | |
| 7,280,432 | B2 | 10/2007 | Hahn et al. | |
| 7,320,370 | B2 | 1/2008 | Virally et al. | |
| 7,327,634 | B2 | 2/2008 | Perry et al. | |
| 7,347,283 | B1 | 3/2008 | Sharp et al. | |
| 7,380,616 | B2 | 6/2008 | Virally et al. | |
| 7,417,920 | B2 | 8/2008 | Hahn et al. | |
| 7,423,932 | B1 | 9/2008 | Jeter | |
| 7,428,922 | B2 | 9/2008 | Fripp et al. | |
| 7,431,688 | B2 | 10/2008 | Wampler et al. | |
| RE40,944 | E | 10/2009 | Seyler et al. | |
| 2002/0117306 | A1 * | 8/2002 | Hahn | E21B 47/18 166/373 |
| 2008/0068929 | A1 | 3/2008 | Hahn et al. | |
| 2011/0056695 | A1 | 3/2011 | Downton | |
| 2013/0277119 | A1 | 10/2013 | Rogers et al. | |
| 2014/0026428 | A1 | 1/2014 | Barnes | |
| 2015/0233237 | A1 | 8/2015 | Logan et al. | |
| 2015/0233238 | A1 | 8/2015 | Logan et al. | |
| 2015/0247403 | A1 | 9/2015 | Logan et al. | |
| 2015/0267534 | A1 | 9/2015 | Gosney et al. | |
| 2015/0275660 | A1 | 10/2015 | Logan et al. | |
| 2015/0292322 | A1 | 10/2015 | Logan et al. | |
| 2015/0300160 | A1 | 10/2015 | Logan et al. | |
| 2015/0322779 | A1 | 11/2015 | Logan et al. | |
| 2015/0330217 | A1 | 11/2015 | Liu et al. | |
| 2015/0377014 | A1 | 12/2015 | Lee et al. | |
| 2015/0377015 | A1 | 12/2015 | Lee et al. | |
| 2015/0377018 | A1 | 12/2015 | Lee et al. | |
| 2016/0010449 | A1 * | 1/2016 | Liu | F15B 21/125 166/66.4 |
| 2016/0245079 | A1 | 8/2016 | Perry et al. | |
| 2016/0258274 | A1 | 9/2016 | Bittar et al. | |
| 2016/0258277 | A1 | 9/2016 | Bittar et al. | |
| 2017/0138186 | A1 | 5/2017 | Lee et al. | |
| 2017/0198570 | A1 | 7/2017 | Lee et al. | |
| 2017/0248010 | A1 | 8/2017 | Lee et al. | |
| 2017/0260853 | A1 | 9/2017 | Stack et al. | |
| 2018/0128099 | A1 * | 5/2018 | Barbely | E21B 47/18 |
| 2018/0171785 | A1 | 6/2018 | Lee et al. | |
| 2018/0230800 | A1 | 8/2018 | Turner | |
| 2019/0017372 | A1 | 1/2019 | Lee et al. | |

FOREIGN PATENT DOCUMENTS

| | | | |
|---|---|---|---|
| EP | 0325047 | A2 | 7/1989 |
| EP | 0333484 | A2 | 9/1989 |
| EP | 0535815 | A1 | 4/1993 |
| EP | 0916807 | A2 | 5/1999 |
| GB | 2156405 | A | 10/1985 |
| WO | 9744565 | A1 | 11/1997 |
| WO | 0229441 | A1 | 4/2002 |
| WO | 2014131125 | A1 | 9/2014 |
| WO | 2016138391 | A1 | 9/2016 |
| WO | 2017069751 | A1 | 4/2017 |

OTHER PUBLICATIONS

Drumheller, Douglas S.; "Coring in Deep Hardrock Formations"; Sandia National Laboratories for the United States Department of Energy; Aug. 1988; 53 Pages.

International Search Report, International Application No. PCT/US2020/065953, dated Apr. 6, 2021, Korean Intellectual Property Office; International Search Report 3 pages.

International Written Opinion, International Application No. PCT/US2020/065953, dated Apr. 6, 2021, Korean Intellectual Property Office; International Written Opinion 5 pages.

Montaron, et al., SPE 25356, "Improvements in MWD Telemetry: "The Right Data at the ight Time"", 1993 (10 pgs.).

Unknown, Stratamagnetic Software, LLC, "Measurement While Drilling" http://www.stratamagnetic.com/features-mwd.htm downloaded Nov. 22, 2019 (11 pgs).

* cited by examiner

OSCILLATING SHEAR VALVE FOR MUD PULSE TELEMETRY AND OPERATION THEREOF

CROSS REFERENCE TO RELATED APPLICATIONS

This application claims the benefit of an earlier filing date from U.S. Provisional Application Ser. No. 62/949,731, filed Dec. 18, 2019, the entire disclosure of which is incorporated herein by reference.

BACKGROUND

Field of the Invention

The present disclosure relates to drilling fluid telemetry systems and, more particularly, to telemetry systems that incorporate an oscillating shear valve for modulating a pressure of a drilling fluid that circulates in a drill string within a well bore.

Description of the Related Art

Drilling fluid telemetry systems, generally referred to as mud pulse systems, are particularly adapted for telemetry (transmission) of information from the bottom of a borehole to the surface of the earth during subsurface operations (e.g., oil well drilling). The information telemetered often includes, but is not limited to, parameters of pressure, temperature, direction, and deviation of the well bore. Other parameters include logging data such as resistivity of various formation layers, sonic density, porosity, induction, self-potential, and pressure gradients. Such information may be critical to efficiency in the drilling operation.

The telemetry operation employs the use of a mud pulse valve to generate pressure pulses within a fluid (i.e., drilling mud). Mud pulse valves must operate under extremely high static downhole pressures, high temperatures, high flow rates, and various erosive flow types. At these conditions, the mud pulse valve must be able to create pressure pulses of around 100-300 psi.

Different types of valve systems can be used to generate downhole pressure pulses to perform telemetry. Valves that open and close a bypass from the inside of the drill string to the wellbore annulus create negative pressure pulses, for example see U.S. Pat. No. 4,953,595. Valves that use a controlled restriction placed in the circulating mud stream are commonly referred to as positive pulse systems, for example see U.S. Pat. No. 3,958,217. The contents of these patents are incorporated herein in their entireties.

It is desirable to increase mud pulse data transmission rates to accommodate large amounts of measured downhole data that is required to be transmitted to the surface. One major disadvantage of available mud pulse valves is a low data transmission rate. Increasing the data rate with available valve types leads to unacceptably large power consumption, unacceptable pulse distortion, or may be physically impractical due to erosion, washing, and abrasive wear. Because of low activation/operational speed, nearly all existing mud pulse valves are only capable of generating discrete pulses. To effectively use carrier waves to send frequency shift (FSK) or phase shift (PSK) coded signals to the surface, the actuation speed must be increased and fully controlled.

An example for a negative pulsing valve is illustrated in U.S. Pat. No. 4,351,037. The content of this document is incorporated herein in its entirety. This technology includes a downhole valve for venting a portion of the circulating fluid from the interior of the drill string to the annular space between the pipe string and the borehole wall. Drilling fluids are circulated down the inside of the drill string, out through the drill bit and up the annular space to surface. By momentarily venting a portion of the fluid flow out a lateral port, an instantaneous pressure drop is produced and is detectable at the surface to provide an indication of the downhole venting. A downhole instrument is arranged to generate a signal or mechanical action upon the occurrence of a downhole detected event to produce the above described venting. The downhole valve disclosed is defined in part by a valve seat having an inlet and outlet and a valve stem movable to and away from the inlet end of the valve seat in a linear path with the drill string.

As will be appreciated by those of skill in the art, all negative pulsing valves need a certain high differential pressure below the valve (i.e., downhole) to create sufficient pressure drop when the valve is open. Because of this high differential pressure, negative pulse valves are typically prone to washing. In general, it is not desirable to bypass flow above the bit into the annulus. Therefore, it must be ensured that the valve is able to completely close the bypass. With each actuation, the valve hits against the valve seat. Because of this impact, negative pulsing valves are more prone to mechanical and abrasive wear than positive pulsing valves.

In contrast to negative pulsing valves, positive pulsing valves might, but do not need to, fully close the flow path for operation. Positive poppet-type valves are less prone to wear out the valve seat. The main forces acting on positive poppet-type valves are hydraulic forces, because the valves open or close axially against the flow stream. To reduce the actuation power some positive poppet-type valves are hydraulically powered as described in U.S. Pat. No. 3,958,217. The content of this document is incorporated herein in its entirety. In such configurations, the main valve is indirectly operated by a pilot valve. The low power consumption pilot valve closes a flow restriction, which activates the main valve to create the pressure drop. The power consumption of this kind of valve is very small. The disadvantage of this valve is the passive operated main valve. With high actuation rates the passive main valve is not able to follow the active operated pilot valve. As such, a pulse signal generated downhole will become highly distorted and hardly detectable at the surface.

An alternative configuration includes rotating disc valves configured to open and close flow channels perpendicular to the flow stream. Hydraulic forces acting against such valves are smaller than for poppet-type valves. However, with increasing actuation speed, dynamic forces of inertia are the main power consuming forces. For example, U.S. Pat. No. 3,764,968 describes a rotating valve configured to transmit frequency shift key (FSK) or phase shift key (PSK) coded signals. The content of this document is incorporated herein in its entirety. The valve uses a rotating disc and a non-rotating stator with a number of corresponding slots. The rotor is continuously driven by an electrical motor. Depending on the motor speed, a certain frequency of pressure pulses are created in the flow as the rotor intermittently interrupts the fluid flow. Motor speed changes are required to change the pressure pulse frequency to allow FSK or PSK type signals. There are several pulses per rotor revolution, corresponding to the number of slots in the rotor and stator. To change the phase or frequency, the rotor is required to increase or decrease in speed. This may take a rotor revolution to overcome the rotational inertia and to achieve the new phase or frequency, thereby requiring several pulse cycles to make the transition. Amplitude coding of the signal is inherently not possible with this kind of continuously rotating device. In order to change the frequency or phase, large moments of inertia, associated with the motor, must be overcome, requiring a substantial amount of power. When continuously rotated at a certain speed, a turbine might be used or a gear might be included to reduce power consumption of the system. On the other hand, both options dramatically increase the inertia and power consumption of the system when changing from one speed to another speed for signal coding.

The aforesaid examples illustrate some of the critical considerations that exist in the application of a fast acting valve for generating a pressure pulse. Other considerations in the use of these systems for borehole operations involve the extreme impact forces, such as dynamic (vibrational) energies, existing in a moving drill string. The result is excessive wear, fatigue, and failure in operating parts of the system. The particular difficulties encountered in a drill string environment, including the requirement for a long lasting system to prevent premature malfunction and replacement of parts, require a robust and reliable valve system.

SUMMARY

Systems and methods for generating pulses in a drilling fluid are provided herein. The methods include driving rotation of a rotor relative to a stator of a pulser assembly in an oscillatory manner, wherein the pulser assembly comprises a tool housing arranged along a drill string and the stator and the rotor are arranged within the tool housing, wherein the stator comprises at least one stator flow passage to allow drilling fluid therethrough and the rotor comprises at least one obstructing element configured to selectively obstruct a fluid flow through the at least one stator flow passage. The oscillatory manner of the driving includes rotating the at least one obstructing element from a middle position to a first blocking angle position such that a first selective obstruction of the at least one stator flow passage by the at least one obstructing element occurs, wherein, the middle position is defined by a minimum of obstruction by the at least one obstructing element of a flow through the at least one stator flow passage and rotating the at least one obstructing element from the first blocking angle position to a second blocking angle position that is opposite the middle position from the first blocking angle position such that a second selective obstruction of the at least one stator flow passage by the at least one obstructing element occurs. Rotation of the at least one obstructing element selectively obstructs the at least one stator flow passage when drilling fluid is flowing through the drill string to generate a pressure pulse in the drilling fluid. Further, the oscillatory manner is an oscillation of the at least one obstructing element between the first blocking angle position and the second blocking angle position such that a single oscillation is between two obstructed states of the at least one stator flow passage.

The rotary pulser assemblies and systems described herein are configured to be positioned along a drill string through which a drilling fluid flows. The rotary pulser includes a housing configured to be supported along the drill string. A stator is supported by the housing, the stator having at least one stator flow passage that extends from an upstream end to a downstream end of the stator. A rotor is positioned adjacent the stator, the rotor including at least one obstructing element, the rotor rotatable to selectively obstruct the at least one stator flow passage with the at least one obstructing element. A motor is coupled to the rotor, wherein the motor assembly is operable to rotate the rotor relative to the stator. A controller configured to drive the motor and rotate the rotor relative to the stator, wherein the controller is configured to drive rotation of the rotor in an oscillatory manner. The oscillatory manner includes a first selective obstruction of the at least one stator flow passage by the at least one obstructing element occurs when the obstructing element is rotated from a middle position to a first blocking angle position, wherein, the middle position is defined by a minimum of obstruction by the obstructing element of a flow through the at least one stator flow passage and a second selective obstruction of the at least one stator flow passage by the at least one obstructing element occurs when the obstructing element is rotated from the first blocking angle position to a second blocking angle position, wherein the second blocking angle position is opposite the middle position from the first angle position. Rotation of the obstructing element selectively obstructs the at least one stator flow passage when drilling fluid is flowing through the drill string to generate a pressure pulse in the drilling fluid. Further, the oscillatory manner is an oscillation of the at least one obstructing element between the first blocking angle position and the second blocking angle position such that a single oscillation is between two obstructed states of the at least one stator flow passage.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

A detailed description of one or more embodiments of the disclosed apparatuses and methods presented herein are presented by way of exemplification and not limitation, with reference made to the appended figures.

Figure 1:
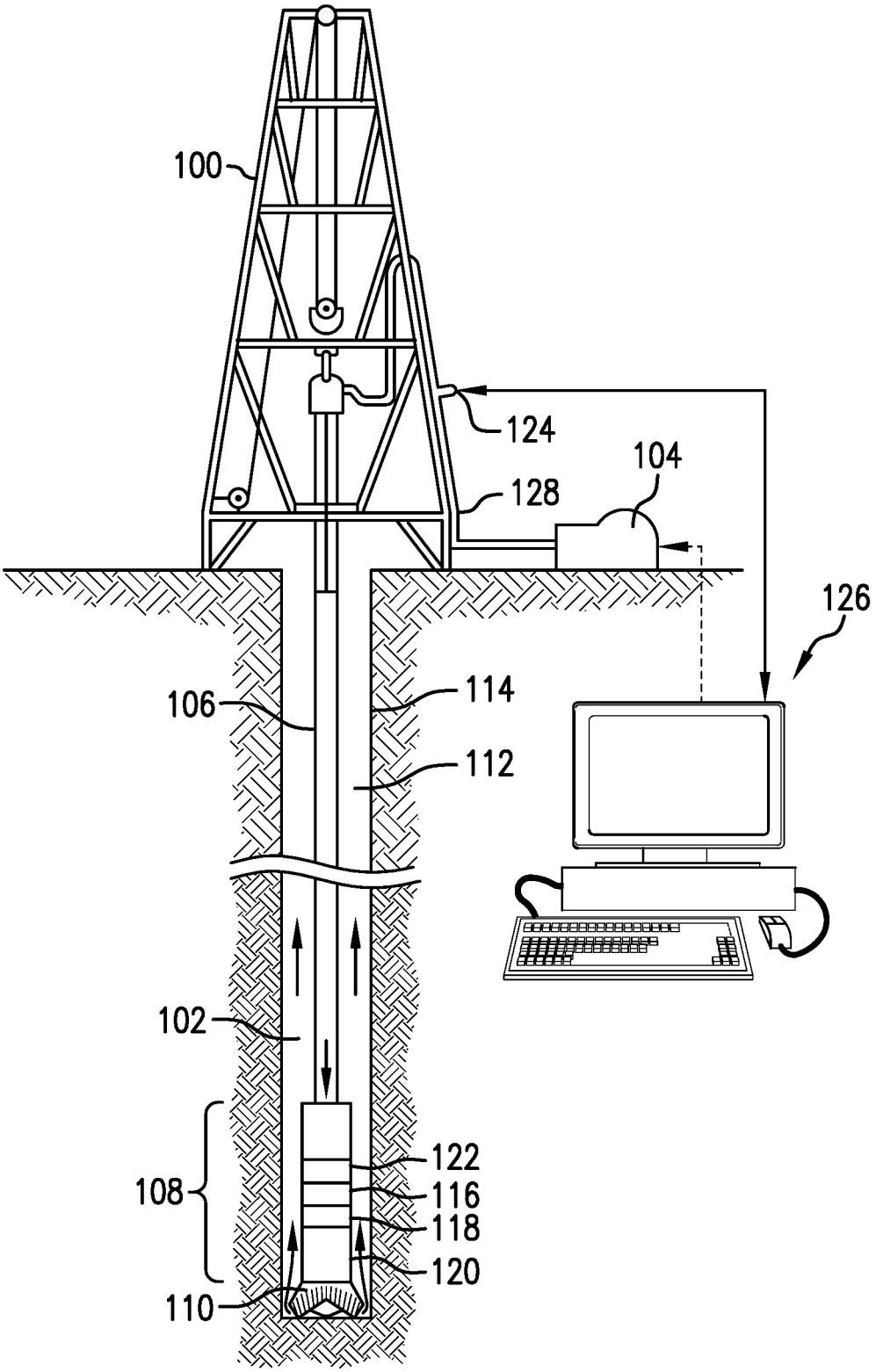
FIG. 1 is a schematic diagram showing a drilling rig 1 engaged in drilling operations that can incorporate embodiments of the present disclosure.

FIG. 1 is a schematic diagram showing a drilling rig 100 engaged in drilling operations. A drilling fluid 102, also called drilling mud, is circulated by a pump 104 through an inner bore of a drill string 106 down through a bottom hole assembly (BHA) 108, through a drill bit 110 and back to the surface through an annulus 112 between the drill string 106 and a borehole wall 114. The BHA 108 can include any of a number of sensor modules 116, 118, 120. The sensor modules 116, 118, 120 can include formation evaluation sensors, directional sensors, probes, detects, etc. as will be appreciated by those of skill in the art. Such sensors and modules are well known in the art and are not described further. The BHA 108 also contains a pulser assembly 122. The pulser assembly 122 is configured to induce pressure fluctuations in a mud flow of the drilling fluid 102. The pressure fluctuations, or pulses, propagate to the surface through the drilling fluid 102 in the drill string 106 and/or through the drilling fluid 108 in the annulus 112 and are detected at the surface by a pulse sensor 124 and an associated a control unit 126. The control unit 126 may be a general purpose or specialized computer or other processing unit, as will be appreciated by those of skill in the art. The pulse sensor 124 is connected to a flow line 128 and may be a pressure transducer or flow transducer, as will be appreciated by those of skill in the art. The BHA 108 includes or defines a longitudinal axis.

Figure 2A:
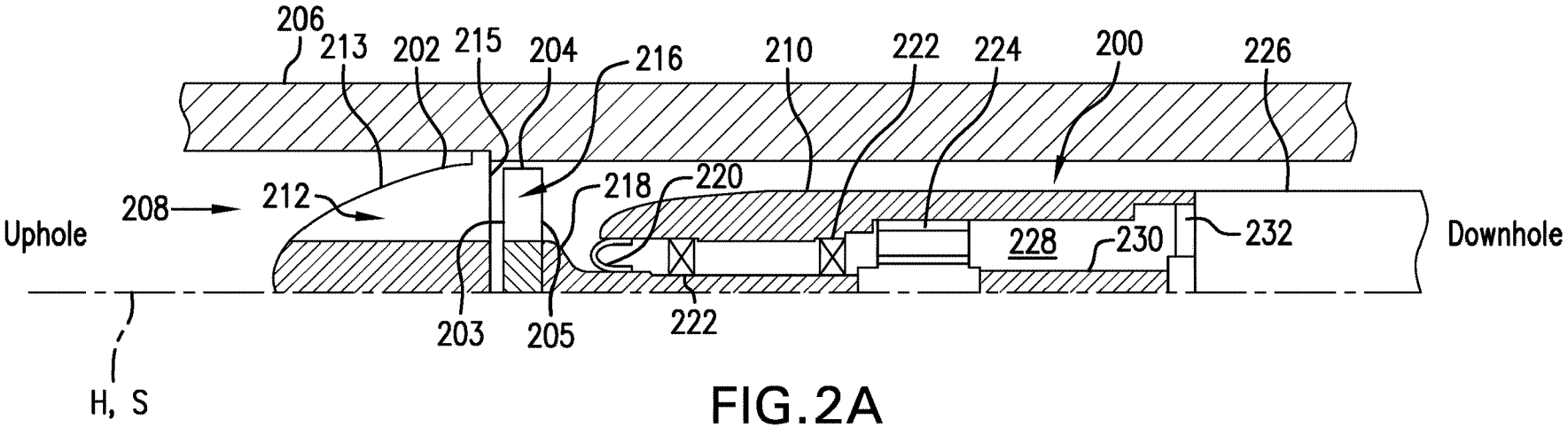
FIG. 2A is a schematic of a pulser assembly that may incorporate embodiments of the present disclosure.
Figure 2C:
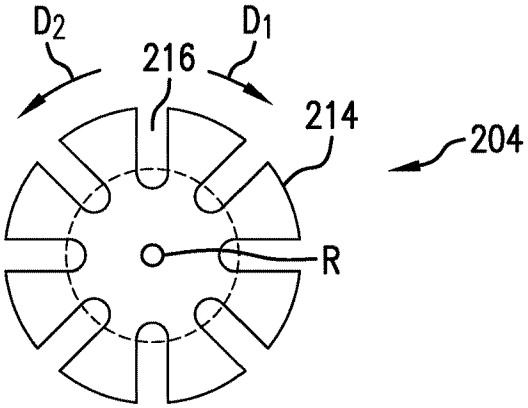
FIG. 2C is a schematic illustration of a rotor of the pulser assembly of FIG. 2A.
Figure 2B:
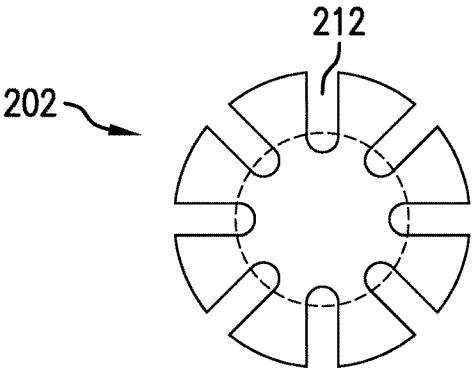
FIG. 2B is a schematic illustration of a stator of the pulser assembly of FIG. 2A.

Turning now to FIGS. 2A-2C, schematic illustrations of a pulser assembly 200 are shown. FIG. 2A is a partial cross-sectional schematic of the pulser assembly 200, FIG. 2B is a schematic of a stator 202 of the pulser assembly 200, and FIG. 2C is a schematic of a rotor 204 of the pulser assembly 200. The pulser assembly 200 may be installed or otherwise employed in downhole systems, such as shown and described with respect to FIG. 1. In this embodiment, the pulser assembly 200 is arranged as an oscillating shear valve assembly that is configured for mud pulse telemetry. The pulser assembly 200, as shown, is arranged in an inner bore of a tool housing 206. In some embodiments, the tool housing 206 may be a bored drill collar in a bottom hole assembly (e.g., as shown in FIG. 1). In other embodiments, the tool housing 206 may be a separate housing adapted to fit into a drill collar bore. Various other configurations are possible without departing from the scope of the present disclosure. The tool housing includes or defines a longitudinal axis H. The longitudinal axis H may be parallel to and/or aligned with the longitudinal axis S of the stator 202. In operation, e.g., while drilling, a drilling fluid 208 will flow through the stator 202 and the rotor 204 and passes through the annulus between a pulser housing 210 and the inner diameter or surface of the tool housing 206. The pulser housing 210 includes or defines a longitudinal axis (not shown). The longitudinal axis of the pulser housing 210 may be parallel to the longitudinal axis H of the tool housing 206. The drilling fluid 208 may be referred to herein as drilling mud, borehole fluid, and/or mud. The drilling fluid may flow in a direction parallel to the longitudinal axis of the housing or the BHA.

The stator 202, shown in FIGS. 2A and 2B, is fixed with respect to the tool housing 206 and to the pulser housing 210. The stator 202 may define or include multiple lengthwise stator flow passages 212. The stator 202 includes or defines an upstream side 213 and a downstream side 215. The rotor 204, shown in FIGS. 2A and 2C, is disk shaped with notched blades 214 (rotor blades) defining rotor flow passages 216 similar in size and shape to the stator flow passages 212 in the stator 202 (although not axially as long, as shown in FIG. 2A). The rotor 204 includes or defines an upstream side 203 and a downstream side 205. Although shown as flow passages (defined by rotor blades), in some embodiments holes or apertures may be formed in the stator and the rotor, respectively. The rotor flow passages 216 are configured such that the rotor flow passages 216 will be aligned, at certain angular positions of the rotor, with the stator flow passages 212 to define straight or substantially straight (i.e., axial) flow paths. The rotor 204 is positioned in close proximity to the stator 202 and is configured to rotationally oscillate or be rotationally driven. An angular displacement (rotation) of the rotor 204 relative to the stator 202 will change the effective flow area of the axial flow paths defined by the flow passages 212, 216, and thus create pressure fluctuations in a circulated mud column. In an alternative embodiment, the rotor may not be disk shaped, but may include an extension on the downstream side.

To achieve one pressure cycle, it is necessary to open and close the axial flow path(s) by changing the angular positioning of the rotor blade(s) 214 with respect to the stator flow passage(s) 212. This can be done with an oscillating movement of the rotor 204 around a rotor shaft axis R. The rotor blades 214 are rotated in a first direction until the flow area is fully or partly restricted. Such partial or full restriction (or blocking) will create or generate a pressure increase in the fluid. The rotor blades 214 are then rotated in the opposite direction to open the flow path again. As the flow paths are opened, the pressure will decrease. The required angular displacement to generate a pressure pulse depends on the design of the rotor 202 and the stator 204. The narrower the flow paths of the pulser assembly 200 are designed, the more the amount of angular displacement required to create a pressure fluctuation is reduced. It is typically desirable for the amount of angular displacement to be relatively small (and thus relatively narrow flow passages 212, 216 may be more desirable). However, narrow flow passages may have the disadvantage of being blocked by debris or foreign particles in a fluid stream, and thus a compromise between narrow flow passages for low displacement and larger flow passages for allowing debris to pass therethrough must be made.

The power required to accelerate the rotor 204 is proportional to the angular displacement of the rotor when oscillating rotationally around the rotor shaft axis R. The lower the angular displacement is, the lower the required actuation power to accelerate or decelerate the rotor 204. As an example, with eight flow passages (rotor flow passages 216) on the rotor 204 and on the stator 202 (stator flow passages 212) and maximizing the cross section of the total flow passage, an angular displacement of approximately 22.5° is used to create a pressure drop. Having such relatively low angular displacement angle may ensure a relatively low actuation energy, even at high pulse frequencies. In some configurations, it may not be necessary to completely block the flow of fluid through the flow paths to create a pressure pulse. As such, different amounts of blockage, or angular rotation of the rotor 204, can be used to create different pulse amplitudes.

The rotor 204, as shown in FIG. 2A, is attached or operably coupled to a rotor shaft 218. As such, the rotation of the rotor shaft 218 can cause rotation of the rotor 204. The rotor shaft 218 passes through a seal 220 and fits through one or more bearings 222. The bearings 222 are configured to fix the rotor shaft 218 in radial and axial position with respect to the pulser housing 210. The rotor shaft 218 is operably connected to a motor 224, with the rotor shaft 218 configured to be rotationally driven by the motor 224. The motor 224 may be, for example, an electric motor, such as a reversible brushless DC motor, a servomotor, or a stepper motor. The motor 224 can be configured to be electronically controlled, such as by circuitry in an electronics module 226. The electronics module 226 can enable precise operation of the rotor 204, such as in an oscillatory movement in both rotational directions (e.g., clockwise and counterclockwise). The precise control of the rotor 204 position provides for specific shaping of a pressure pulse generated by a fluid flow (e.g., drilling mud) through the pulser assembly 200. The electronics module 226 may contain a programmable processor which can be preprogrammed to transmit data utilizing any of a number of encoding schemes which include, but are not limited to, Amplitude Shift Keying (ASK), Frequency Shift Keying (FSK), or Phase Shift Keying (PSK) or the combination of these techniques.

In some embodiments, the tool housing 206 can include one or more pressure sensors, not shown, mounted in locations above and below the pulser assembly 200. Such pressure sensors may be configured with a sensing surface exposed to the fluid in the drill string bore. The pressure sensors can be powered by the electronics module 226 and may be configured to receive surface transmitted pressure pulses. The processor and/or circuitry in the electronics module 226 may be programmed to alter data encoding parameters based on received surface transmitted pressure pulses. The encoding parameters can include type of encoding scheme, baseline pulse amplitude, baseline frequency, angular displacement of the rotor, angular position of the rotor in middle position, or other parameters affecting the encoding of data. In alternative embodiments, the BHA 108 may include a turbine driven by the mud flow. In such embodiments, the turbine may be used to receive the surface transmitted pulses through measurement of turbine revolution fluctuations.

The pulser housing 210 may be filled with an appropriate lubricant 228 to lubricate the bearings 222 and to pressure compensate the interior of pulser housing 210 with a downhole pressure of the drilling mud 208. The bearings 222 are typical anti-friction bearings known in the art and are not described further. In some embodiment, and as shown, the seal 220 may be configured as a flexible bellows seal that directly couples to the rotor shaft 218 and to the pulser housing 210. As such, the seal 220 may seal (e.g., hermetically) the lubricant 228 (e.g., oil) filled pulser housing 210. The angular movement or rotation of the rotor shaft 218, as driven by the motor 224, causes a flexible material of the seal 220 to twist, thereby accommodating the angular motion while maintaining the sealing of the lubricant 228 within the pulser housing 210. In some embodiments, flexible bellows material of the seal 220 may be an elastomeric material, a fiber-reinforced elastomeric material, or other suitable material as will be appreciated by those of skill in the art. Depending on the material of the seal 220, the arrangement of components, etc., it may be necessary to keep the angular rotation of the rotor shaft 218 relatively small so that the material of the seal 220 will not be overstressed by the twisting motion. In other configurations, the seal 220 may be an elastomeric rotating shaft seal or a mechanical face seal, as will be appreciated by those of skill in the art. That is, the seal 220 may take various configurations and arrangements that provides for a sealed, lubricant-filled internal structure of the pulser assembly 200, without departing from the scope of the present disclosure.

In some embodiments, the motor 224 may be configured with a double-ended motor shaft or a hollow motor shaft. In some such embodiments, one end of the motor shaft is attached to the rotor shaft 218 of the rotor 204 of the pulser assembly 200 and the other end of the motor shaft is attached to a torsion spring 230. The torsion spring 230 may be anchored to an end cap 232. In such embodiments, the torsion spring 230, the rotor shaft 218, and the rotor 204 are configured as a mechanical spring-mass system. The torsion spring 230 is designed such that the spring-mass system is at its natural frequency at, or near, a desired oscillating pulse frequency of the pulser assembly 200. The methodology for designing a resonant torsion spring-mass system is well known in the mechanical arts and is not described here. The advantage of a resonant system is that once the system is at resonance, the motor 224 only has to provide power to overcome external forces and system dampening, while the rotational inertia forces are balanced out by the resonating system. In an alternative embodiment, the torsion spring may be attached to the rotor shaft.

Embodiments of the present disclosure are directed to rotary pulser assemblies (i.e., pulsers) and methods for operating such assemblies. The pulser assemblies include a housing, a stator supported by the housing, a rotor adjacent the stator, and a motor assembly coupled to the rotor, such as shown and described above with respect to FIGS. 2A-2C. An electronics module is configured to control motion or operation of the motor assembly, and thus rotation of the rotor. The motion or rotation of the rotor can be an oscillation. That is, the rotor may be driving in a first direction of rotation $D_1$ and in a second (opposite) direction of rotation $D_2$, with a directional change between such driving. In some embodiments, a specific angle of rotation may be performed relative to a central location, such that, when starting at the central or middle position, the rotor may be driven in the first direction a predefined angle of rotation, and when reaching such angle, the direction of rotation may be reversed and thus rotated in the second direction. As the rotor is rotated in the second direction of rotation $D_2$, the rotor may pass through the central or middle position and continue rotational travel to the same predefined angle of rotation (but opposite from the first direction of rotation $D_1$). The term opposite refers to opposite directions of rotation of the rotor or to angular positions of the rotor that can be reached from the middle position by rotating the rotor in opposite directions of rotation. That is, rotating from an angular position to an opposite angular position of the rotor includes passing the middle position.

The rotor 204 may include one or more obstructing elements 214, such as the blades shown and described in FIGS. 2A-2C. The obstructing elements may be sized and shaped to at least partially (and possibly completely) block a flow of fluid through a flow passage 212, conduit, or aperture of a stator that is arranged adjacent the rotor (e.g., as shown in FIGS. 2A-2C). FIG. 2B and FIG. 2C provide cross sectional views of the stator 202 and the rotor 204 from an uphole perspective, respectively. The one or more obstructing elements 214 and the one or more rotor flow passages 216 rotate with the rotor when the rotor is rotated by the motor. In a default or rest state (when the motor is off), as indicated with the orientation of the stator 202 and the rotor 204 relative to each other, the rotor may be arranged such that a flow path is open, and an obstructing element is not blocking, or is minimal blocking a flow passage of the stator. However, the rotor is configured to be driven in a rotational manner such that the obstructing element may block or otherwise restrict a flow of fluid through the flow passage of the stator (i.e., by blocking the stator flow passage).

Figure 3:
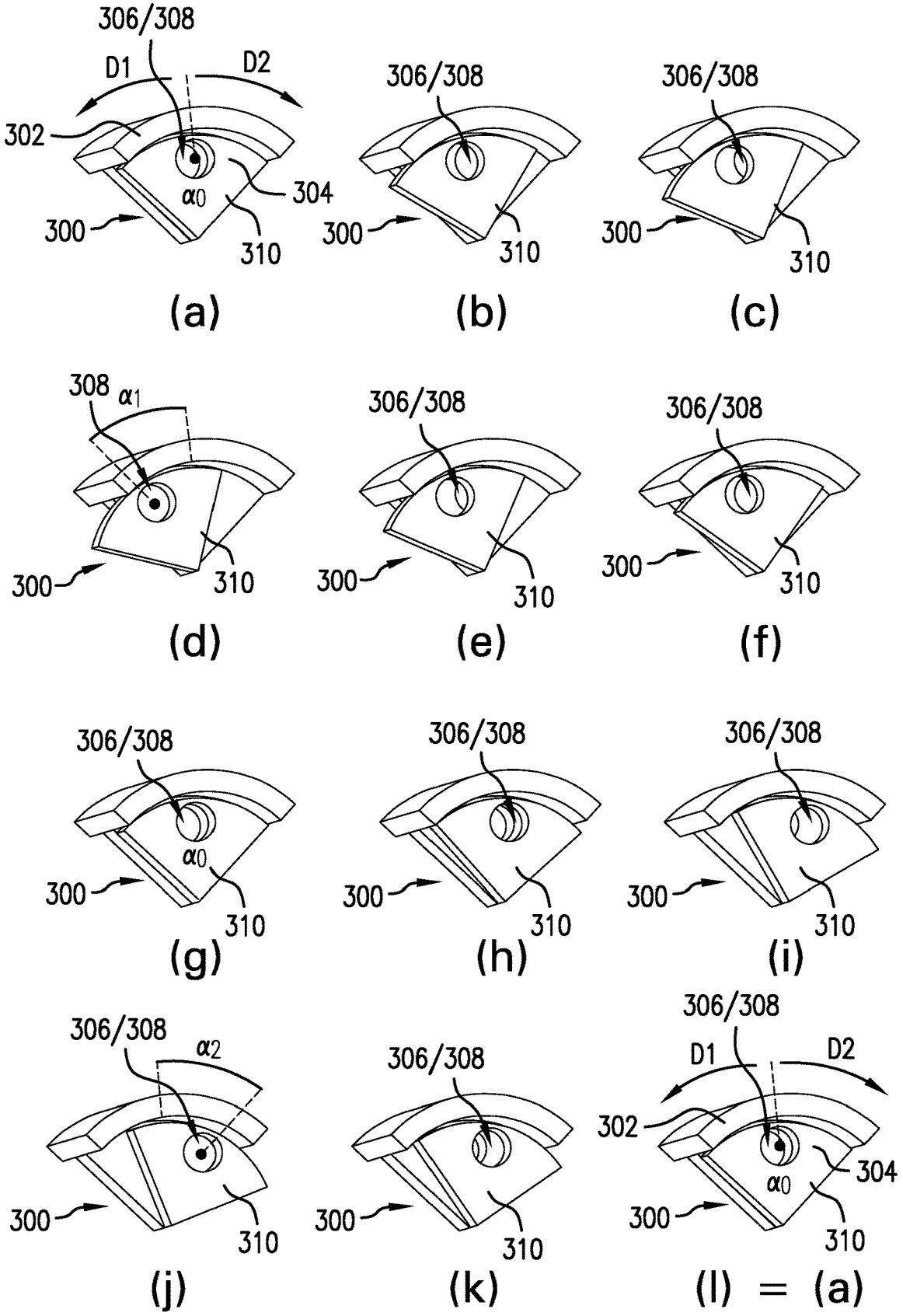
FIG. 3 is a sequence of images of operation of a pulser assembly in accordance with an embodiment of the present disclosure.

Because the flow path is open or at least partially open (e.g., minimum obstruction position) at rest (or the motor-off state), the rotor may be rotated from a middle (open) position to a maximum obstruction position (i.e., closed or partially closed) whereby one or more obstructing elements obstruct fluid flow through one or more respective flow paths of a stator. As one example, the rotor may be rotated in the first direction of rotation $D_1$ to obstruct a flow channel when the rotor is rotated a predefined first blocking angle $\alpha_1$ (as shown in FIG. 3). The rotor will cease rotation movement (angular velocity $\omega_{min1}=0$) at the first blocking angle $\alpha_1$, and then be reversed in the second direction of rotation $D_2$, thereby reducing the obstruction until reaching a minimum obstruction at a middle position $\alpha_0$ (as shown in FIG. 3). The rotation will continue from the middle position $\alpha_0$ in the same direction (i.e., second rotational direction $D_2$), and pass by or over the middle position at a maximum rotational velocity $\omega_{max}$ of the rotor, and rotate to a second maximum obstructed position at a second blocking angle $\alpha_2$ (as shown in FIG. 3). Again, the rotor will cease rotation movement ($\omega_{min}=0$) at the second blocking angle $\alpha_2$ and then reverse direction of rotation (i.e., into the first direction of rotation $D_1$), again reducing obstruction until reaching a minimum obstruction at the middle position $\alpha_0$.

The rotation will continue from the middle position $\alpha_0$ in the same direction (i.e., in the first direction of rotation $D_1$), and pass by or over the middle position $\alpha_0$ at a maximum rotational velocity $-\omega_{max}$ of the rotor, and rotate back to the first maximum obstructed position at a first blocking angle $\alpha_1$. The rotor cycle from the first blocking angle position $\alpha_1$ where the rotational direction is reversed ($D_1$ to $D_2$) over the middle position $\alpha_0$ with the maximum rotational velocity (prim to the second blocking angle $\alpha_2$ where the rotational direction is again reversed ($D_2$ to $D_1$) back toward and over the middle position $\alpha_0$ with the maximum rotational velocity $-\omega_{max}$ to the first blocking angle position $\alpha_1$ represents one rotational oscillation cycle of the rotor. The rotor flow passage that aligns with a specific stator flow passage at the middle position $\alpha_0$ when the motor is off, aligns during one rotational oscillation cycle of the rotor with the specific stator flow passage two times at the middle position $\alpha_0$. During the two alignments during the one rotational oscillating cycle, the rotational velocity is maximum, $\omega_{max}$ in rotational direction $D_2$ and $-\omega_{max}$ in rotational direction $D_1$. In such a configuration and operation, the middle position $\alpha_0$ may represent or be defined by an angle of 0°. The specific rotor cycle from a first closed position with minimum rotational velocity over an open position with a maximum rotational velocity to a second closed position and back over the open position to the first closed position is new and provides significant advantages with respect to the pulse form created by the rotary pulser over prior art systems as described herein.

For example, turning to FIG. 3, a series of schematics of operation of a portion of a pulser assembly 300 in accordance with an embodiment of the present disclosure is shown. The pulser assembly 300 includes a stator 302 and a rotor 304 that is rotatable relative to the stator 302. The rotational movement of the rotor 304 may be driven by a motor, as described above. The stator 304 includes a stator flow passage 306 and the rotor 304 includes a rotor flow passage 308, and when the rotor flow passage 308 is aligned with the stator flow passage 306, a flow path through the pulser assembly 300 is defined. The rotor 304 further includes at least one obstructing element 310 that can be rotated to block or otherwise obstruct a fluid flow through the stator flow passage 306.

The series of schematics in FIG. 3 illustrate the oscillatory motion of the rotor 304 relative to the stator 302, and specifically the blocking or obstruction that is provided by the obstructing element 310 (e.g., a section of the rotor without a flow passage) as it moves relative to the stator flow passage 306. FIG. 3 illustrates a series of orientations (a)-(l) that illustrate the orientation of the rotor 304 relative to the stator 302. At orientation (a) of FIG. 3, the rotor 304 is at rest (e.g., a driving motor is off) and the rotor flow passage 308 is aligned with the stator flow passage 306 and the obstructing element 310 does not block or otherwise obstruct, or is at a minimum obstruction of the flow through the flow path defined by the aligned flow passages 306, 308. The obstructing element 310 is configured with a size and shape to ensure sufficiently blocking (either partial or complete) of the stator flow passage 306 when the obstructing element 310 is moved to align with the stator flow passage 306. The series of orientations (a)-(l) described below will be with respect to a counterclockwise rotation first at orientations (b)-(d) (e.g., first direction of rotation $D_1$), followed by a clockwise rotation at orientations (e)-(j) (e.g., second direction of rotation $D_2$), and ending with a counterclockwise rotation back to the starting orientation at orientations (k)-(l) (e.g., middle position). It will be appreciated that with respect to the above description that the directions counterclockwise and clockwise are defined with respect to a downhole perspective on the rotor. The terms downstream and downhole refer to a location at the drill bit side of the pulser assembly. The terms upstream and uphole refer to a location at the surface side of the pulser assembly.

At orientation (a) the rotor 304 is shown at a base angle position $\alpha_0$. The base angle position $\alpha_0$ is a default angle with respect to a reference orientation of 0° for when the pulser assembly 300 is at rest and/or the motor is off. In some configurations, as described below, the rotor 304 may be biased to the base angle position $\alpha_0$ such that regardless of a position of the rotor 304 when the motor is turned off, the rotor 304 will return to the base angle position $\alpha_0$ due to the biasing force. Such biasing may be achieved by a torque spring (e.g., torsion spring) or other similar biasing element that is configured to return the rotor 304 to the base angle position $\alpha_0$ when no rotational force is applied thereto. As the oscillatory rotation of the rotor is performed around the base angle position $\alpha_0$ (middle position) the spring load of the torsion spring is zero in the base angle position $\alpha_0$. In the middle position the torsion spring is not tensioned (e.g., spring is released). It is to be mentioned that the twist of the seal 220 may also contribute to the biasing force toward the base angle position $\alpha_0$. In an alternative embodiment, the electric motor (e.g., electric brake) or another electrical or mechanical mechanisms may bias the rotor in the base angle position.

At orientation (b), the rotor 304 is rotated in a counterclockwise direction (e.g., first direction of rotation $D_1$) relative to the stator 302 such that a portion of the obstructing element 310 will block or otherwise obstruct a portion of the stator flow passage 306. As shown, at orientation (b), the amount of alignment or overlap between the stator flow passage 306 and the rotor flow passage 308 is less than when the rotor 304 is at the base angle $\alpha_0$. Thus, an amount of obstruction of the flow path defined by the rotor flow passage 308 and the stator flow passage 306 will be increased, thereby increasing a pressure of the fluid.

At orientation (c), the rotor 304 is further rotated in the counterclockwise direction (e.g., first direction of rotation $D_1$) relative to the stator 302 such that the portion of the obstructing element 310 blocking or obstructing the stator flow passage 306 increases. As shown, at orientation (c), the amount of alignment or overlap between the stator flow passage 306 and the rotor flow passage 308 is less than when the rotor 304 is at orientation (b). Thus, an amount of obstruction of the flow path defined by the rotor flow passage 308 and the stator flow passage 306 will be further increased, thereby increasing a pressure of the fluid even more than at orientation (b).

At orientation (d), the rotor 304 is further rotated in the counterclockwise direction relative to the stator 302 such that the obstructing element 310 completely blocks or obstructs the stator flow passage 306. As shown, at orientation (d), the rotor flow passage 308 does not overlap with any straight portion of the stator flow passage 306, and thus pressure increase is at a higher value than at orientation (b) and orientation (c). Because there is an axial gap or distance between the adjacent faces of the rotor 304 and the stator 302 (between a downstream side of stator and an upstream side of rotor), flow is forced to flow around the outer diameter of the rotor 304 or through the rotor flow passage, the axial gap and finally through the rotor flow passage 308. At orientation (d), the rotor 304 has been rotated to a full extent of a single blocking oscillation, and thus ends at a first blocking angle position $\alpha_1$. When the rotor 304 has been rotated to the first blocking angle position $\alpha_1$, the rotational direction (e.g., first direction of rotation $D_1$) will change (reverse) to rotate clockwise, and thus, at the first blocking angle position $\alpha_1$, the rotational velocity of the rotor 304 will reach zero and reverse direction (e.g., second direction of rotation $D_2$). At orientation (d) and the first blocking angle position $\alpha_1$, the biasing member (e.g., torsion spring) provides a maximum repulsing force $F_1$ (first biasing force) toward the base angle position $\alpha_0$ of the rotor 304. The gap between the adjacent faces of the rotor 304 and the stator 302 may be a few millimeters up to a few centimeters wide. A typical gap may be between 2 to 6 mm wide.

Orientations (e)-(j) illustrate the clockwise rotation of the rotor 304 relative to the stator 302. As shown, the flow path defined by the overlapping of the rotor flow passage 308 and the stator flow passage 306 increases in amount as the rotor 304 rotates. At orientation (g), the rotor 304 passes through the base angle $\alpha_0$, and then continues past the base angle $\alpha_0$ in a clockwise direction (e.g., second direction of rotation $D_2$). At orientation (j) the rotor 304 is rotated fully in the clockwise direction of an oscillation such that a second maximum obstruction is achieved. At orientation (j), the rotor 304 has been rotated to a full extent of a single blocking oscillation, and ends at a second blocking angle position $\alpha_2$. When the rotor 304 has been rotated to the second blocking angle position $\alpha_2$, the rotational direction (e.g., the second direction of rotation $D_2$) will change to rotate counterclockwise (e.g., the first direction of rotation $D_1$), and thus, at the second blocking angle position $\alpha_2$, the rotational velocity of the rotor 304 will reach zero and reverse direction. As shown, at orientation (j), the rotor flow passage 308 does not overlap with any straight portion of the stator flow passage 306, and thus at the second blocking angle position $\alpha_2$ a maximum pressure increase is achieved. At orientation (j) and blocking angle position $\alpha_2$, the biasing member (e.g., torsion spring) provides a maximum of a repulsing force $F_2$ (second biasing force) toward the base angle position $\alpha_0$, wherein the repulsing force $F_2$ has at least a component in the opposite direction of the first biasing force $F_1$. The biasing forces $F_1$ and $F_2$ act on the rotor 304 to support rotation back to the base angle position $\alpha_0$. The biasing forces $F_1$ and $F_2$ may be tangential forces and act in opposite tangential directions, wherein tangential relates to a circumference of the rotor. A value of the second blocking angle $\alpha_2$ may be equal to a value of the first blocking angle $\alpha_1$.

In FIG. 3, orientations (k)-(l) illustrate the rotor 304 returning to the base angle $\alpha_0$ such that the stator flow passage 306 and the rotor flow passage 308 are aligned and the flow path is fully open. In orientation (1) the rotor has reached again the starting position (a). If another pulse is desired, the rotor 304 may continue the counterclockwise rotation as shown in orientations (b)-(d), or even a full oscillation of orientations (b)-(j) or orientations (b)-(l). For a series of pressure pulses, a sequence of operation through the orientations (d) to (j) and the respective counterclockwise sequence of orientations (j) to (d) is repeated. Such continuous series of oscillations can create a continuous series of pressure pulses. The term "fully open," as used in this disclosure, refers to a rotor orientation relative to the stator that corresponds to a maximum fluid flow and/or corresponds to a minimum obstruction of the flow path in a given stator rotor combination. The rotor flow passage may be smaller in a cross section perpendicular to at least one of the longitudinal axis of the tool housing 206 (FIG. 2A) and the flow direction of the drilling fluid 208 (FIG. 2A).

As such, as described with respect to FIG. 3, the pulser assembly 300 is configured to rest at an open position, and oscillate between two closed positions during operation. Further, during operation, because the open position is between the two closed positions, the obstructing element 310 of the rotor 304 will be traveling at a maximum rotational velocity+/−$\omega_{max}$ as the rotor flow passage 308 passes two times during one rotor cycle over the stator flow passage 306 in the rotational direction $D_1$ and $D_2$, when assuming a sinusoidal movement of the rotor 304. Additionally, the obstructing element 310 of the rotor 304 will reach a zero rotational velocity $\omega_{min1}/\omega_{min2}$ at the extents of rotational movement (i.e., first and second blocking angles $\alpha_1$, $\alpha_2$, first and second reversal points), and thus the stator flow passage 306 will be blocked (i.e., maximum obstruction) at a maximum oscillation configuration ($\alpha_1$, $\alpha_2$) of the pulser assembly 300 while the rotational direction changes from $D_1$ to $D_2$ or $D_2$ to $D_1$.

Advantageously, as compared to prior oscillating configurations, the pulser assembly of embodiments described herein has a much higher velocity or transition through the open position, when assuming a sinusoidal movement of the rotor 304. The sinusoidal input for the rotational movement, having zones with low velocity at the two closed position (i.e., maximum obstruction, minimum rotational velocity), the velocity through the middle of the movement cycle is at a maximum (i.e., minimum obstruction, maximum rotational velocity). At the middle position of the described setup, the obstruction is minimal or zero (i.e., an open channel through the flow path defined by the stator and rotor flow passages). Because the pressure buildup is over-proportionally rising toward the closed positions and under-proportionally rising near the open position, a faster transition through open state and a slower transition through closed state creates a more sinusoidal pressure signature over time. Such sinusoidal pressure signals are beneficial for pressure pulse decoding at the surface, and thus the present configuration provides for a more efficient system.

Additionally, as noted above, the base angle $\alpha_0$ is a default angle for when the pulser assembly is at rest and/or the motor is off. That is, in a de-energized state (i.e., power off), the rotor flow passage is automatically aligned with the stator flow passage (i.e., open state). Such default of an open state may be achieved using a torsion spring, such as shown and described in U.S. Pat. No. 6,626,253, entitled "Oscillating shear valve for mud pulse telemetry," the content of which is incorporated herein by reference in its entirety.

In some embodiments, the torsion spring may be attached to the motor and the pulser housing. The torsion spring is designed such that the combination of the torsion spring and the rotating masses (i.e., the rotor, rotor shaft, seals, etc.) creates a torsionally resonant spring-mass system near a desired operating frequency of the pulser assembly. Accordingly, the pulser assembly may have a neutral-moment free-state in the middle position. Thus, the open position may be maintained when the motor is de-energized or off. An open position, as opposed to a half way obstructed position like in U.S. Pat. No. 6,626,253, has the benefit of creating lower flow restriction (e.g., lower pressure drop) in the de-energized state and has lower susceptibility for plugging or unintentional blockage in the de-energized state. The rotor cycle containing a passage of the open position at a maximum rotational velocity leads to an oscillation ($\alpha_1$, $\alpha_2$) from the middle position that is twice the oscillation angle and a maximum oscillation velocity+/−$\omega_{max}$ that is half of the oscillating velocity compared to prior systems.

Figure 4:
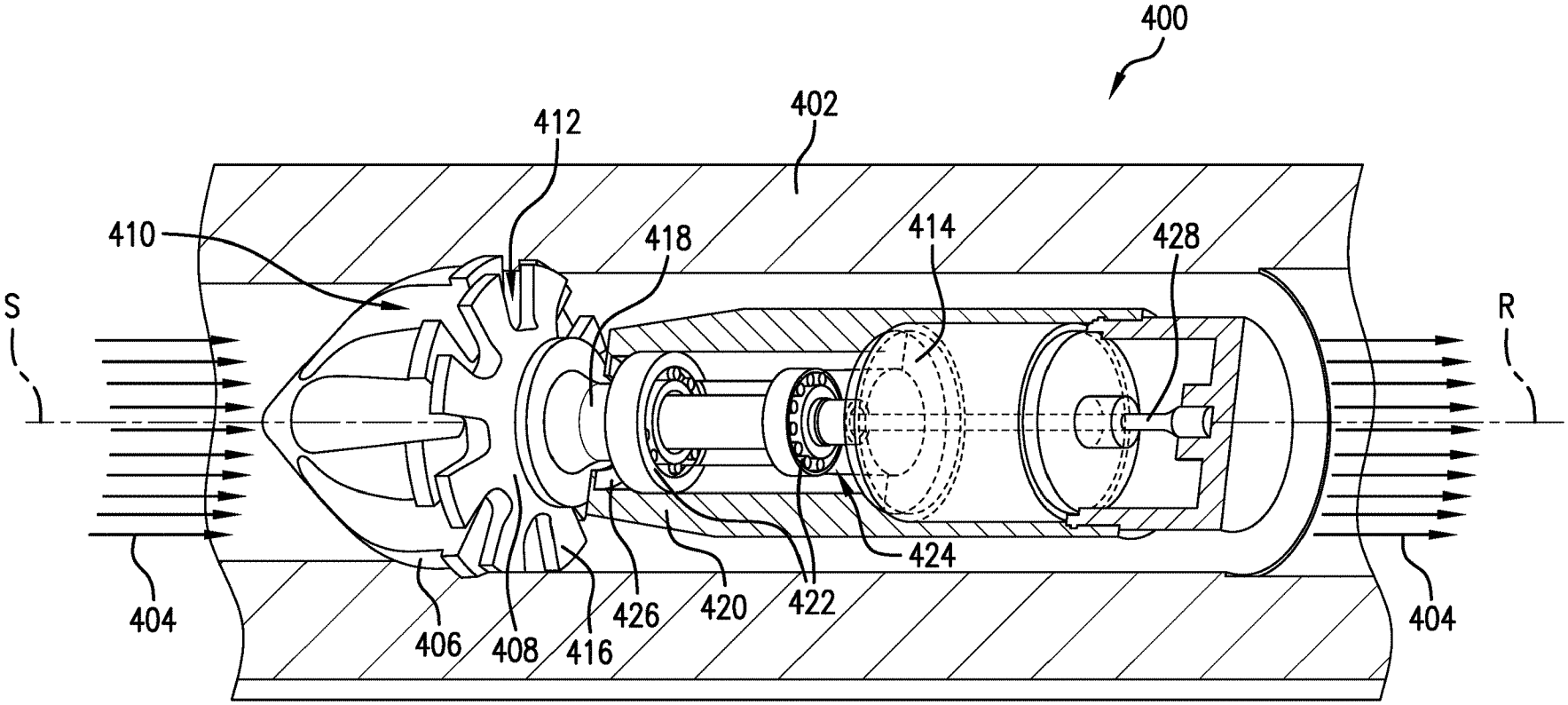
FIG. 4 is a schematic illustration of a pulser assembly in accordance with an embodiment of the present disclosure.

Turning now to FIG. 4, a schematic illustration of a pulser assembly 400 in accordance with an embodiment of the present disclosure is shown. The pulser assembly 400 may be operable similar to that described above, with a default or de-energized position that is open, and a driving oscillation between two closed positions. The pulser assembly 400 includes a tool housing 402 through which drilling mud 404 may pass. Arranged within the tool housing 402 is a stator 406 and a rotor 408 arranged relative to the stator 406. The stator 406, in this illustrative embodiment, defines a number of stator flow passages 410 and the rotor 408 includes an equal number of rotor flow passages 412. As described above, when the rotor flow passages 412 are aligned with the stator flow passages 410, a flow path may be defined such that the drilling mud 404 may flow through the pulser assembly 400. In operation, the rotor 408 may be rotatably driven by a motor 414 to have one or more obstructing elements 416 that will block (partially or wholly) the stator flow passages 410 to obstruct a flow of the drilling mud 404 through the pulser assembly 400.

The pulser assembly 400 includes a rotor shaft 418 that operably connects the motor 414 to the rotor 408. The motor 414 may be a brushless motor, as will be appreciated by those of skill in the art. The rotor shaft 418 is rotatably mounted within a bearing housing 420 by one or more bearings 422. A lubricant 424 may be contained within the bearing housing 420 to lubricate and enable rotational movement of the rotor shaft 418 as driven by the motor 414. The lubricant 424 can be sealingly contained within the bearing housing 420 by a seal 426, as described above. The seal 426 is configured to retain the lubricant within the bearing housing 420 and prevent the drilling mud 404 from entering the bearing housing 420. The seal 426 is configured to ensure such sealing even during rotation of the rotor shaft 418 relative to the seal 426. Also, shown is a torsion spring 428 operably connected to the rotor shaft 418 to ensure that the rotor shaft 418 (and the attached rotor 408) will return to a specific and predefined position when the motor 414 is off (i.e., the open position of a flow path defined when the stator flow passages 410 are aligned with the rotor flow passages 412).

The pulser assembly, in accordance with some embodiments, may be operated to perform a sinusoidal or substantially sinusoidal oscillation of the rotor 408 relative to the stator 406. Further, the pulser assembly 400, in accordance with some embodiments, may be employed for various different modulation schemes. For example, without limitation, a processor or other controller may be configured to drive operation of the pulser assembly to transmit data utilizing any of a number of encoding schemes which include, but are not limited to, Amplitude Shift Keying (ASK), Frequency Shift Keying (FSK), Pulse Position Modulation (PPM), Quadrature Phase Shift Keying (QPSK), or Phase Shift Keying (PSK), or combinations of these techniques. Further, in some embodiments, the amplitude of the generated signal may be controlled or adjusted through controlled operation of the pulser assembly. For example, different amounts of blockage, or angular rotation, can be used to create different pulse amplitudes. That is, in some embodiments, the maximum angle of rotation $\alpha_1$, $\alpha_2$ (closed state) may be controlled and adjusted to enable different amplitudes of pressure pulses to be generated. The specific modulation technique, oscillation pattern, amplitude, etc. may be controlled by a controller operably connected to a motor of the pulser assembly. The controller may be configured to receive a downlink from the surface with instructions for a specific type of operation, such as amplitude, signal strength, modulation scheme, oscillation pattern, maximum angle, oscillation frequency, etc. Such downlink may be used to change a specific operational parameter of the pulser assembly.

In accordance with embodiments of the present disclosure (e.g., as illustrated in FIG. 3), the minimum number of obstructing elements is one, which may be rotated to selectively obstruct fluid flow through a flow path of a pulser assembly. The number of obstructing elements may be based, in part, on the desired angular extent $\alpha_1$, $\alpha_2$ of rotation for obstruction. For example, in one non-limiting embodiment, a relatively high number of obstructing elements may lead to a smaller angle of oscillation $\alpha_1$, $\alpha_2$. Further, the relative angular dimension of the obstructing element(s) relative to an opening of a stator flow passage may be configured for a desired operation. For example, in various illustrations shown herein, the obstructing element may be about the same size and shape of an opening of a respective stator flow passage that is selectively obstructed by the obstructing element. However, in other embodiments, the obstructing elements may be larger or smaller than the opening of the stator flow passage. That is, in some non-limiting embodiments, the angular arc or extent (angular dimension) of an obstructing element may be greater than the angular arc or extent of a respective opening of a stator flow passage. In the same fashion, the radial dimension of the obstructing element may be smaller or bigger as the radial dimension of the stator flow passage, with the term "radial" referring to a direction perpendicular to the rotor shaft axis.

In some embodiments, the pulser assemblies of the present disclosure can include various additional components. For example, the pulser assemblies may include controllers, processors, sensors, feedback elements, etc. that may be operably connected to and/or in communication with a controller of the pulser assembly. Such electronic elements and components may be used to operate the pulser assembly as described herein. For example, one or more pressure sensors may be mounted in locations above and below the pulser assembly to monitor a pressure upstream and downstream from the pulser assembly. Such pressure sensors may be configured with a sensing surface exposed to the fluid in a drill string bore. The pressure sensors can be powered by an electronics module, as described above, and may be configured to receive surface transmitted pressure pulses. The processor and/or circuitry in such electronics module may be programmed to alter data encoding parameters based on received surface transmitted pulses. The encoding parameters can include type of encoding scheme, baseline pulse amplitude, baseline frequency, maximum angle or other parameters affecting the encoding of data.

The pressure sensor mounted above the pulser assembly may be used to measure the pressure difference between an open position and a closed position of the flow path. With varying fluid flow (flow rate variation) the pressure difference between the open and closed position may change, which may affect the pressure pulse decoding at surface. This is due to the amplitude of the pressure signal received changing with changing pressure difference. For example, the desired pressure in a fluid column in the inner bore of the drill string above the pulser assembly may be 50 bar in the open position and may be 20 bar in the closed position of the flow path. Such a configuration provides a pressure difference of 30 bar. If the flow rate of the fluid pumped through the inner bore of the drill string varies during a downhole operation, the pressure difference may change. Based on the change in pressure difference, measured by the pressure sensor above the pulser assembly, the controller of the pulser assembly may vary pulser assembly parameters, such as base frequency or maximum angle to adjust, to achieve again a pressure difference of 30 bar. The pressure sensor below the pulser assembly allows measurement of the difference between the pressure above and below the pulser assembly.

Figure 5A:
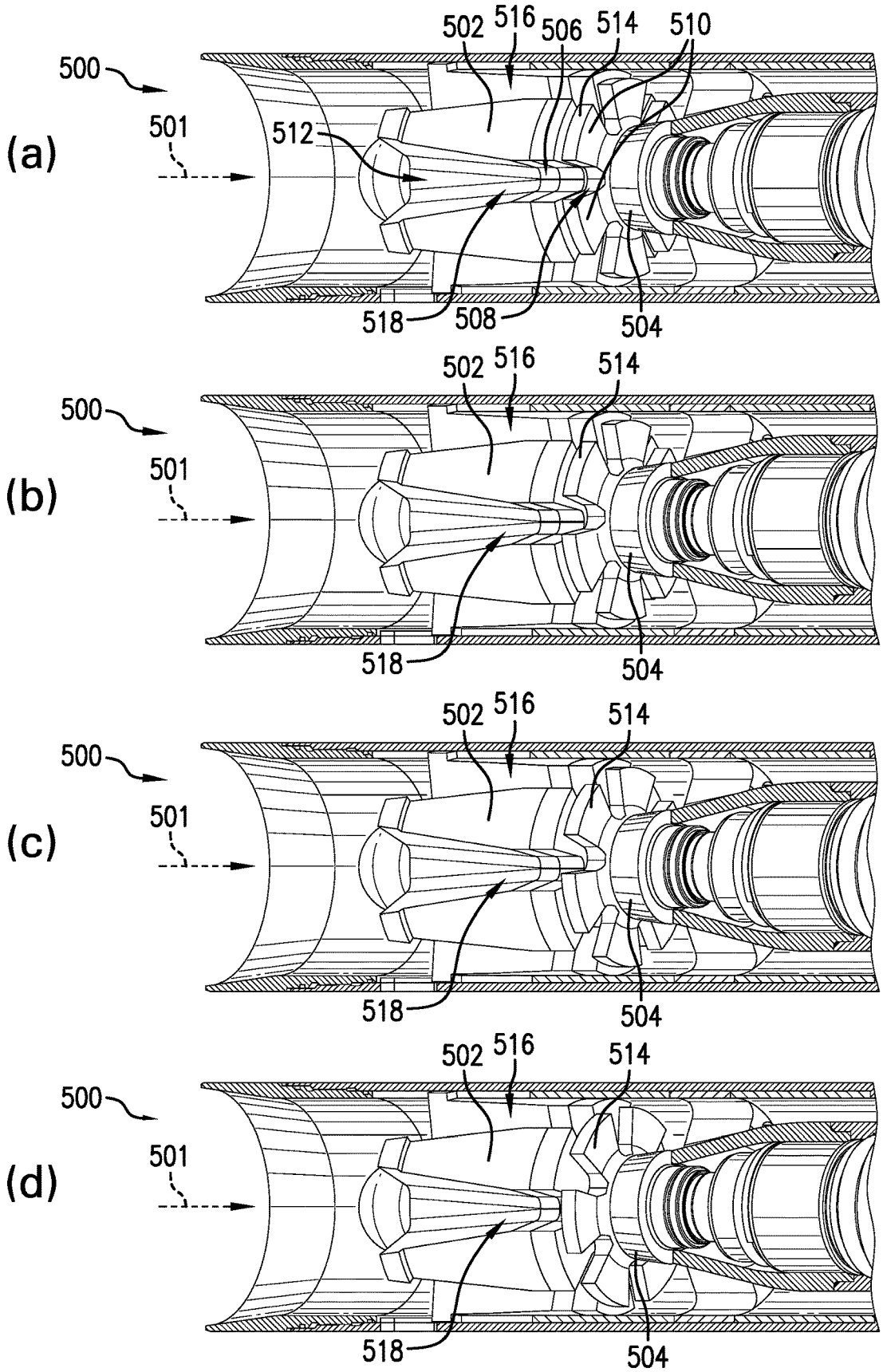
FIG. 5A is a sequence of images of operation of a pulser assembly in accordance with an embodiment of the present disclosure, illustrating a transition from an open position to a first closed position.
Figure 5B:
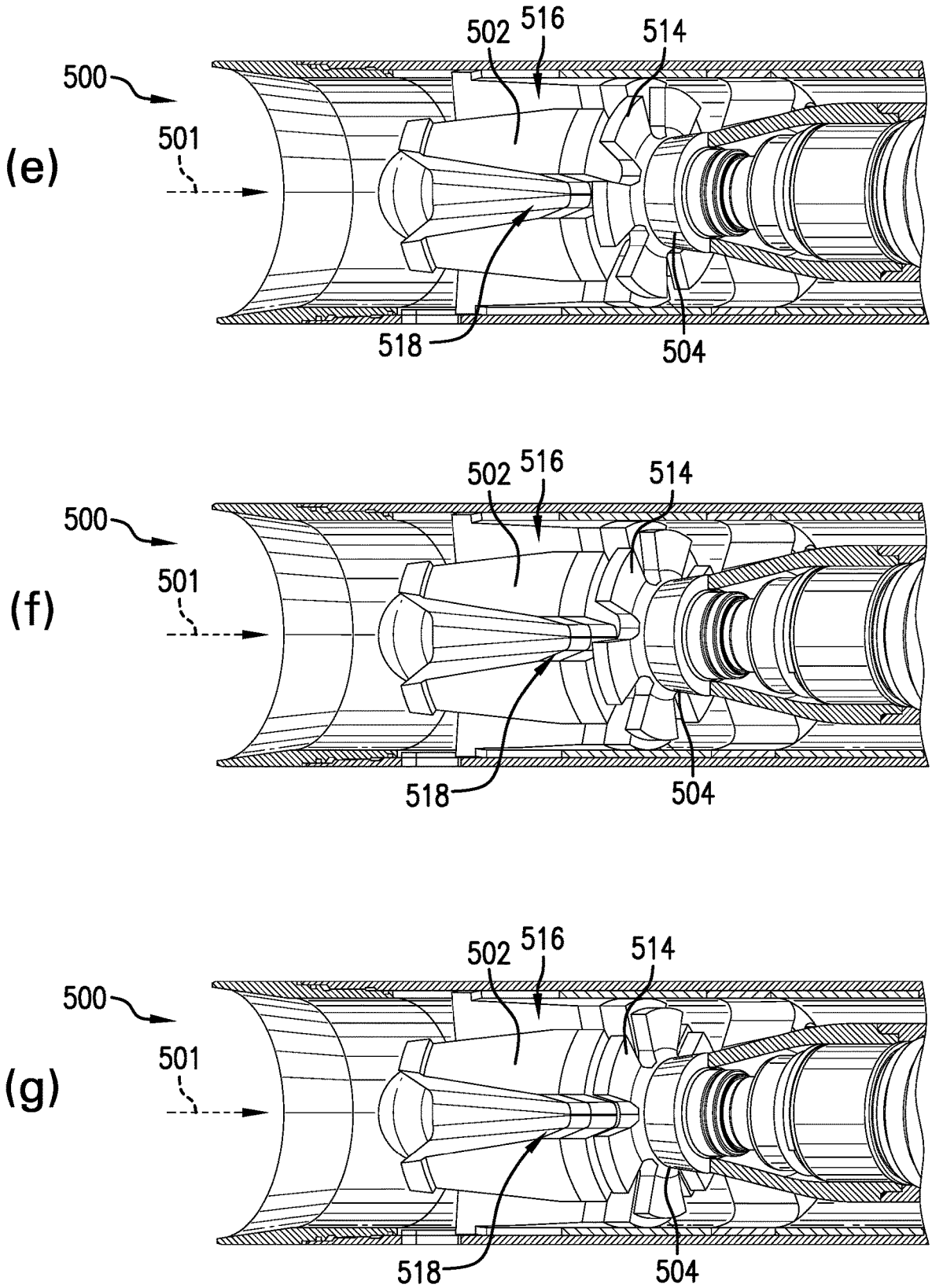
FIG. 5B is a sequence of operation of the pulser assembly of FIG. 5A illustrating a transition from the first closed position back to the open position.
Figure 5C:
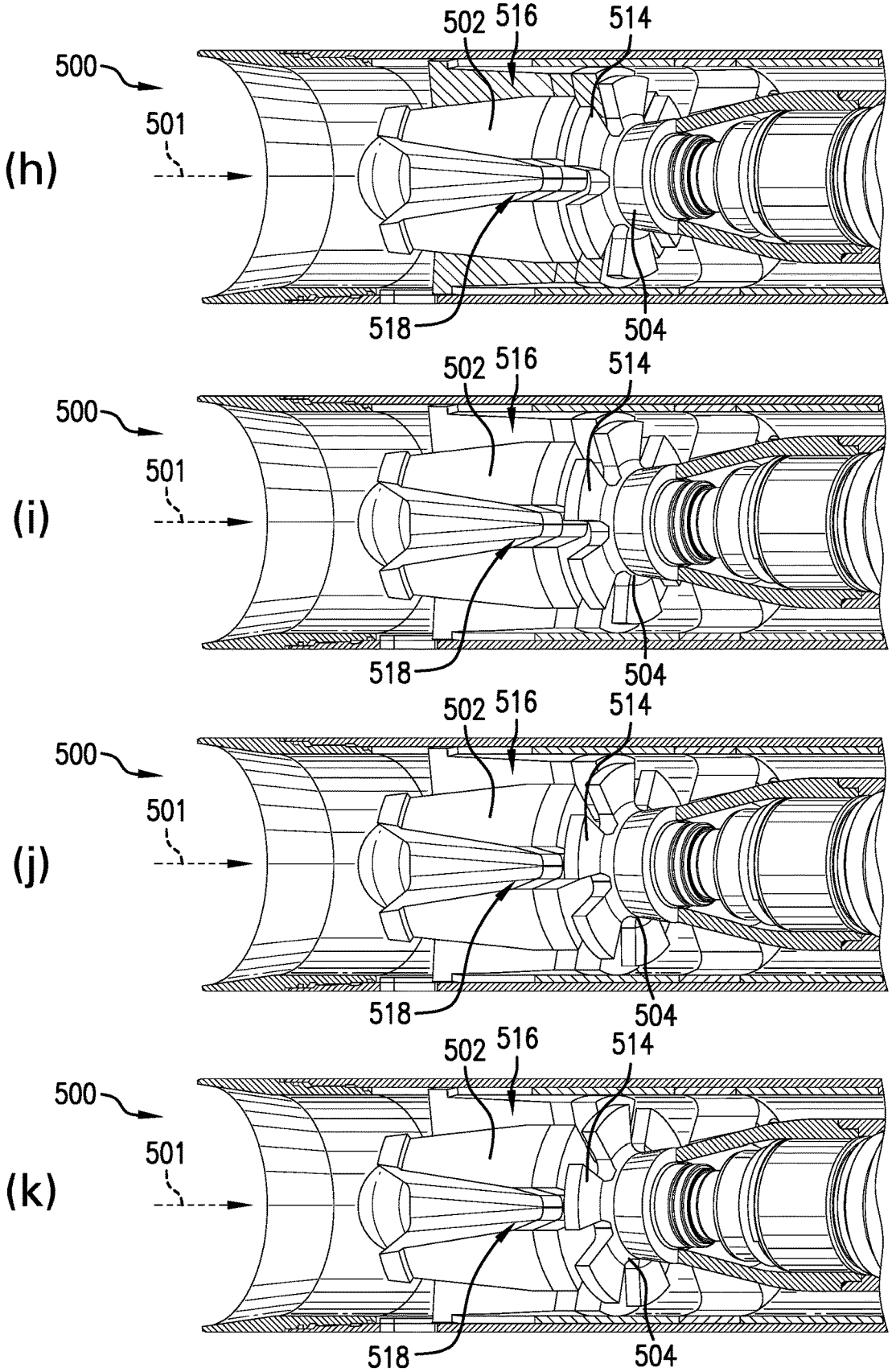
FIG. 5C is a sequence of operation of the pulser assembly of FIG. 5A illustrating a transition from the open position to a second closed position.

Turning now to FIGS. 5A-5C, a series of schematics of operation of a pulser assembly 500 in accordance with an embodiment of the present disclosure is shown. The pulser assembly 500 includes a stator 502 and a rotor 504 that is rotatable relative to the stator 502. A fluid flow 501 is from the left to the right in FIGS. 5A-5B. As such, the fluid flow 501 flows into the pulser assembly 500 in a direction from the surface toward the pulser assembly 500 (as shown by the arrow of fluid flow 501). The fluid flow 501 will flow into the stator 502, through one or more flow paths 512 defined by stator flow passages 506 and toward the rotor 504. In some embodiments, the rotor 504 is positioned downstream from the stator 502 (e.g., as shown in FIGS. 5A-5C). However, in other embodiments, the rotor may be arranged upstream of the stator or a rotor may be arranged between two stators. The rotational movement of the rotor 504 may be driven by a motor, as described above. The stator 502 includes a number of stator flow passages 506 and the rotor 504 includes a number of rotor flow passages 508 defined between obstructing elements 510. When the rotor flow passages 508 are aligned with the stator flow passages 506, flow paths 512 are defined through the pulser assembly 500. When the obstructing elements 510 are aligned with the stator flow passages 506, a fluid flow through the flow paths 512 is obstructed (either wholly or partially). Even if the flow path 512 is wholly obstructed, there will remain a secondary flow path around the obstructing element 510, thus enabling flow to bypass the rotor but at a higher pressure than with less obstruction.

FIGS. 5A-5C illustrate a sequence of orientations of the rotor 504 rotated relative to the stator 502 to illustrate the orientation of the obstructing elements 510 relative to the stator flow passages 506 during an oscillation of the rotor 504. FIG. 5A illustrates a sequence of a first open-to-close sequence (orientations (a)-(d)) with a first open orientation shown at orientation (a) and a first close orientation shown at orientation (d). FIG. 5B illustrates a sequence of a transition from the first close orientation (d) to a second open orientation (g). FIG. 5C illustrates a sequence of a transition from the second open orientation (g) to a second close orientation (k). FIGS. 5A-5C are made with reference to a specific obstructing element 514 as it is rotated relative to a first stator flow passage 516 and a second stator flow passage 518.

Orientation (a) illustrates the open position, with the rotor flow passage 508 aligned with the stator flow passage 506, and thus the flow path 512 is at a maximum flow opening. In this orientation, the obstructing element 514 does not obstruct flow through any flow path 512, and is aligned with a portion of the stator 502. However, as the process transitions from orientation (a) to orientation (b) to orientation (c), the rotor 504 is rotated relative to the stator 502 such that the obstructing element 514 will start to block or overlap with the first stator flow passage 516. It will be appreciated that other obstructing elements 510 will obstruct flow through other stator flow passages 506, including the second stator flow passage 518, however, the present description will be made only with respect to the obstructing element 514 as it obstructs flow through the first and second stator flow passages 516, 518. As such, the obstructing element 514 will restrict or block a flow through the flow path 512 that passes through the first stator flow passage 516. At orientation (d), the obstructing element 514 is aligned with the first stator flow passage 516 (maximum angle position) and thus the flow path 512 through the first stator flow passage 516 is maximally obstructed (e.g., substantially blocked), thus a high pressure is created in the flow upstream of the rotor 504 (first maximum blocking). At the orientation (d), the rotational velocity of the rotor 504 is zero.

Turning to the sequence shown in FIG. 5B, the rotational direction of the rotor 504 is reversed and the orientations of the rotor 504 relative to the stator 502 are reversed. As shown, the obstructing element 514 transitions from orientation (e) through orientation (g), and thus transitioning from the maximum blocking (orientation (d)) back to a maximum open position at orientation (g).

The rotational motion of the rotor 504 will continue beyond the central orientation (orientation (g)) and the obstructing element 514 will travel beyond the open position to a second (opposite) maximum angle position (at zero velocity, and maximum blocking). That is, the obstructing element 514 will continue in the oscillation to obstruct a flow through the second stator flow passage 518 (orientations (h) through (k)), as shown in FIG. 5C. Thus, the rotational aspect of embodiments of the present disclosure is a transition from an open position at start (orientation (a)), to a first closed position (orientation (d)), reverse rotational direction, through the open position (orientation (g)), and to a second closed position that is angular opposite of the first closed position (orientation (k)), and then repeated in an oscillatory manner. As such, assuming a sinusoidal movement, the maximum rotational velocity will occur at orientations (a) and (g) during operation (the open position) and minimum rotational velocity (i.e., zero) will occur at the maximum closed positions (orientations (d) and (k)). The reversal points of the rotor oscillation will occur at the maximum closed position.

As noted above, a sinusoidal driving of the rotor may be suggested to conserve energy when using a close-to-close movement of obstructing elements, as provided by embodiments of the present disclosure. Under such control, as discussed, the minimum rotational velocity is at the extremes of the close state, and the maximum rotational velocity is at the extreme of the fully open state. The cyclic pattern of the oscillation, in accordance with embodiments of the present disclosure, is thus between closed states and a short open state between the closed states with a neutral-moment free-state in the middle (open) position. This allows for the use of a torsion spring (e.g., spring 428) that is operably connected to the rotor shaft and the attached rotor. The torsion spring causes the rotor to return to a specific and predefined position or orientation when the motor is off. That is, when the motor is deactivated or shut off, the rotor will return to a position or orientation relative to the stator that has maximum open flow paths through the pulser assembly. Additionally, such configurations allow for the use of a torsionally resonant spring-mass system that can be operated near or at a desired operating frequency of the pulser assembly.

Figure 6A:
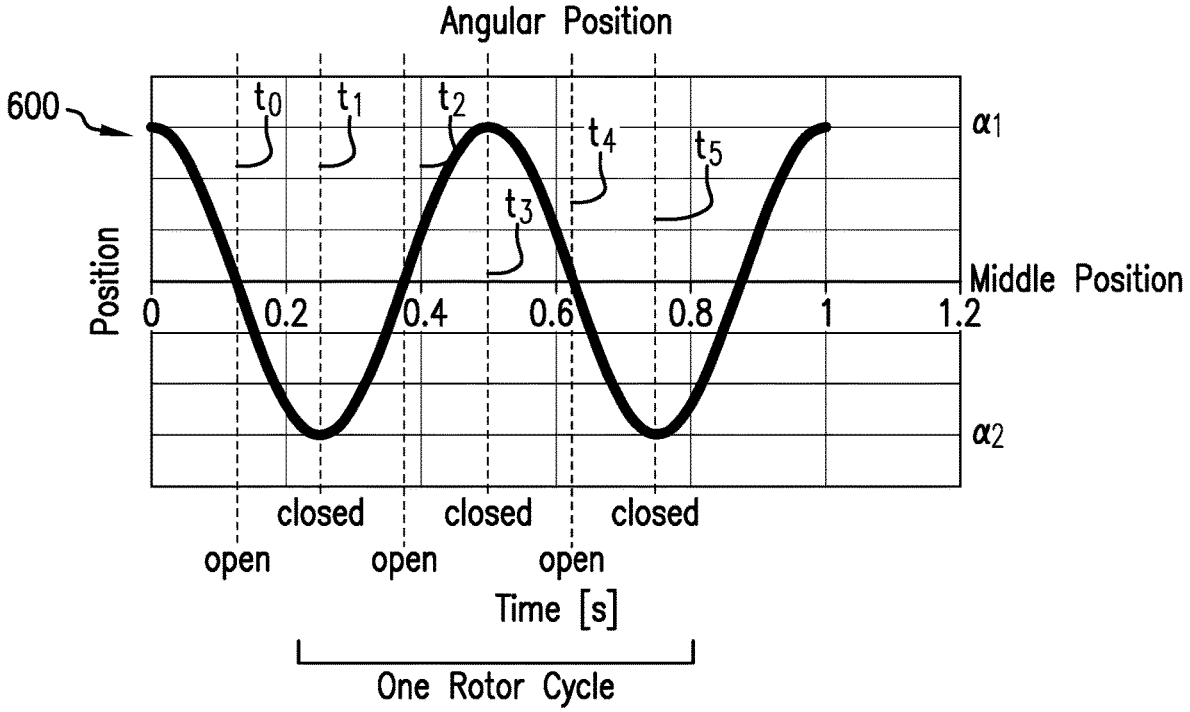
FIG. 6A is a plot of angular position as a function of time of an operation in accordance with an embodiment of the present disclosure.
Figure 6B:
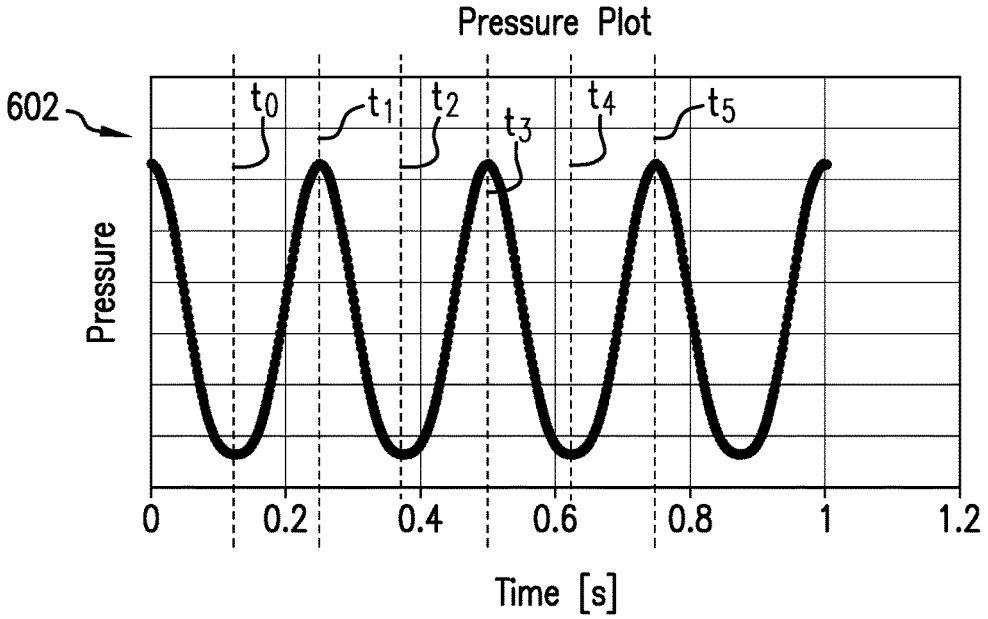
FIG. 6B is a plot of pressure as a function of time of an operation in accordance with an embodiment of the present disclosure.
Figure 6C:
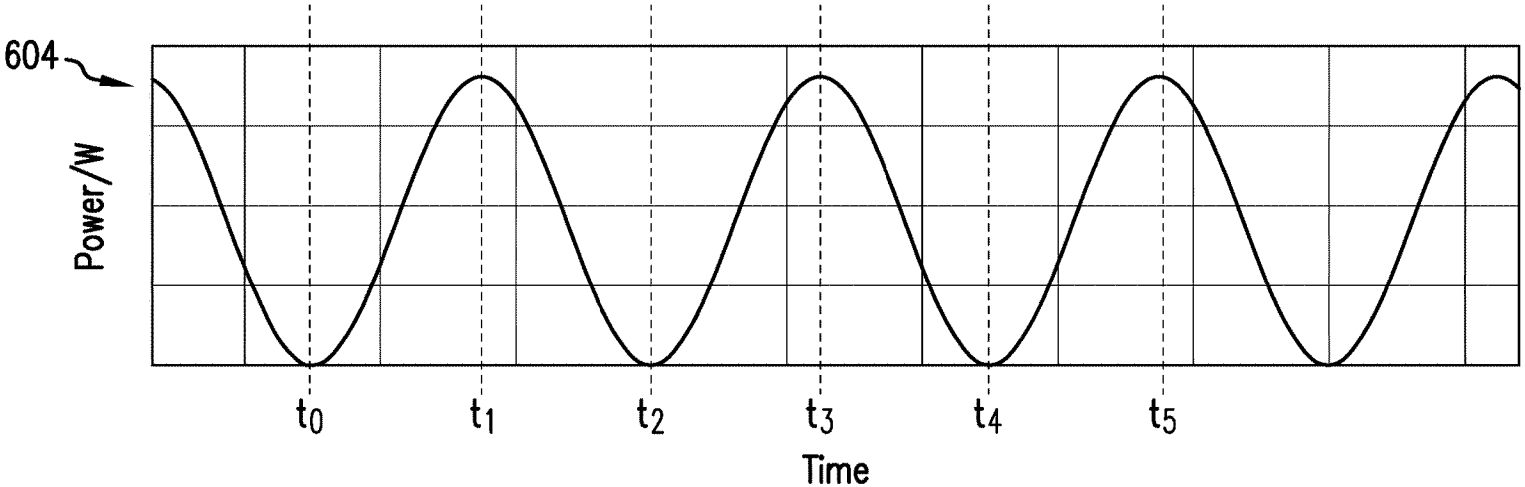
FIG. 6C is a plot of a power consumption of an electric motor that drives a rotor during operation in accordance with an embodiment of the present disclosure.
Figure 6D:
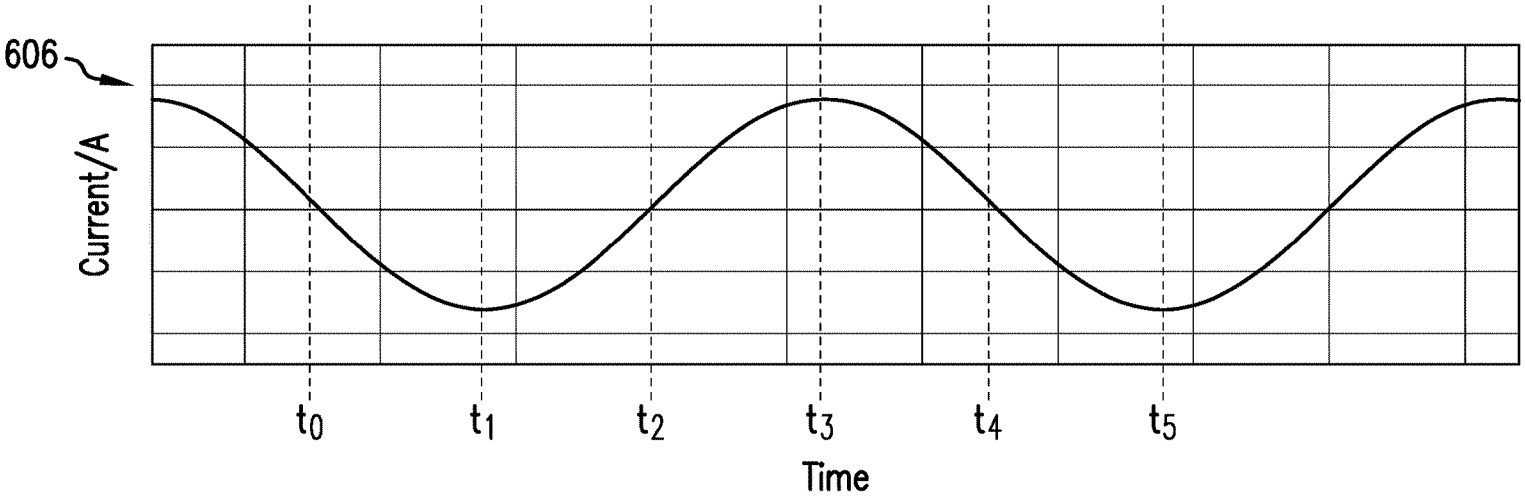
FIG. 6D is a plot of a current drawn by a motor during operation in accordance with an embodiment of the present disclosure.

Turning now to FIGS. 6A-6D, schematic plots representing an oscillatory operation of a pulser assembly in accordance with an embodiment of the present disclosure are shown. Plot 600, shown in FIG. 6A, represents an angular position of a rotor relative to a stator of the pulser assembly. Plot 602, shown in FIG. 6B, represents a pressure plot of a drilling mud within or above the pulser assembly. Plot 604, shown in FIG. 6C, represents a power consumption of the electric motor that drives the rotor. Plot 606, shown in FIG. 6D, is a schematic plot of the current drawn by the motor.

When, in FIG. 6A, the position of the rotor is at the minimum angle position ($\alpha_0$) (middle position), a flow path through the pulser assembly will be fully open, and at a maximum angle positions di and $\alpha_2$, the flow path through the pulser assembly may be partially or wholly blocked by obstructing elements that are covering or otherwise blocking respective stator flow passages, as shown and described above.

In plots 600, 602, time to represents a position of the rotor in the middle position. This may be the rest position of the rotor, such as a power state of a driving motor is off or it may be the middle position during a rotor cycle. As shown in plots 600, 602, time to is at time 0.125 s. The rotor will be rotated into the first rotational direction toward the first closed position of a closed-to-closed sequence. At time 0.25 s, labeled as time $t_1$, the angular position of the rotor is at a first maximum closed position (e.g., first blocking angle $\alpha_1$, as described above) and an obstructing element will block a stator flow passage to prevent or maximally restrict flow through a flow path of the pulser assembly. In one non-limiting example, a first rotational direction of the rotor may be clockwise, and an obstructing element will close the flow path. At time $t_1$, the pressure is at a maximum, as shown in FIG. 6B (first pulse). This position and pressure, at time $t_1$, is the start of a close-to-close pulse sequence. In this example, the actuation frequency may be 2 Hz actuation. That is, at time $t_1$, the pulser assembly is in a maximum closed position, and the rotation of the rotor is at zero angular velocity (a reversal point), thus creating a first high pressure state at time $t_1$. That is, the pressure during the rotor cycle is at a maximum at time $t_1$.

From time $t_1$, the rotor will reverse direction and travel in a counterclockwise direction through the open position or state (middle position) at time $t_2$ (time 0.375 s). At time $t_2$, the rotor will be rotating with maximum rotational velocity and the pressure will again be at the lowest during the rotor cycle. However, the rotor will continue to rotate in the second rotational direction, counterclockwise, to a second maximum angle position of the rotor $\alpha_1$, opposite the first maximum angle position of the rotor with respect to the middle position, at time $t_3$ (time 0.5 s). This rotation, from time $t_1$ (closed) to time $t_3$ (closed) is a half cycle of the rotor. At time $t_3$, the rotor is at the second reversal point and at the second maximum close position. The second reversal point is like the first reversal point, having a zero angular velocity and creating a second high pressure state (second pulse). The rotor will then reverse direction (change back to a clockwise rotation) and pass through the center (position 0 or middle position, e.g., as shown at time to) and to the first extreme reversal position again. Thus, at time $t_4$ (time 0.625 s), the pulser assembly is open and a low pressure is achieved, but at the highest/maximum rotational velocity of the rotor. The rotor will return to the maximum close position at time $t_5$ (time 0.75 s) and again reach a zero rotation velocity to reverse direction and to end one closed-to closed cycle.

FIG. 6C is a schematic plot of the power consumption of the electric motor that drives the rotor. The power consumption is at a maximum at times $t_1$ and $t_3$ when the rotor is at the first maximum closed position and the second maximum closed position and the pressure is at a maximum. The power consumption is at a minimum at times $t_2$ and $t_4$ when the rotor is in the middle position and the pressure is at a minimum. FIG. 6D is a schematic plot of the current drawn by the motor. The current is zero at times $t_2$ and $t_4$ when the rotor passes the middle position and the pressure is at a minimum. The current is at a maximum at times $t_1$ and $t_3$ when the rotor is at the first and second maximum closed position. The polarity of the current chances between the first ($t_1$) and second ($t_3$) maximum closed position as the rotational direction of the rotor (and the motor) changes to the opposite rotational direction.

Figure 7:
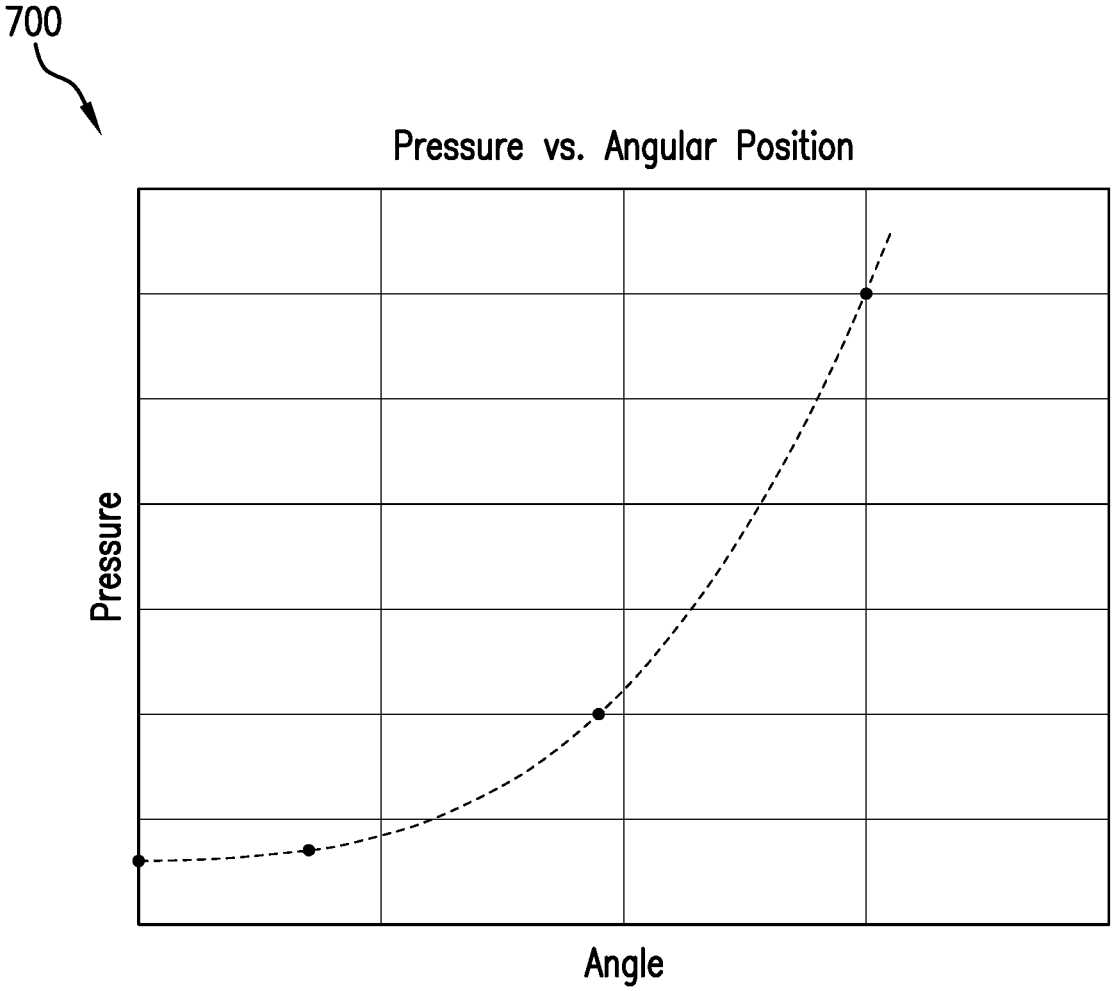
FIG. 7 is a plot of pressure as a function of angular position of a pulser assembly.

FIG. 7 is a schematic plot 700 illustrating the relationship between angular position and pressure in the mud column above the pulser assembly. At the left side of the plot 700 the rotor is in an angular position that allows fluid flow (open position or near open position). With increasing angle (along the x-axis) the at least one obstruction element of the rotor more and more closes or obstructs the fluid passage causing an increasing pressure in the mud column. As illustrated, the relationship is non-linear. Because of this non-linear relationship, prior systems generated pressure curves with a relatively high crest factor. Crest factor is a parameter of a waveform that represents a ratio of a peak value to the effective value. Stated another way, the crest factor indicates how extreme a peak of a waveform is. The relatively high crest factor (and extreme peaks) of the prior systems reduced the effective signal transmission strength.

Embodiments of the present disclosure can optimize the pressure pulses by concentrating the energy in the base frequency (carrier frequency) through creation of pressure curves, which contain only few higher harmonics with relatively low amplitudes in the transmitted signal. Thus, maximizing of the effective signal strength may be achieved. As can be seen in pressure curves (e.g., FIG. 6B), sine pressure curves are generated by a sine movement input (e.g., at the rotor). That is, the motor of the pulser assembly may be driving using a sine movement input to drive the oscillations of the rotor. It is noted that the frequency in pulse pressure is double the mechanical frequency by the fact that two pressure cycles are generated in one mechanical cycle (one rotor cycle). Furthermore, a minimum of mechanical input power to generate the signal may be achieved through embodiments of the present disclosure (e.g., torsion spring, no gear, larger rotation angle at lower angular velocities). This may be useful for high carrier frequencies (pressure fluctuations), such as higher than, for example, 10 Hz (5 Hz mechanical rotor oscillation frequency). Such minimizing can be achieved by driving the oscillatory movement of the rotor by a sinusoidal drive by the motor. As such, in accordance with some non-limiting embodiments, a sinusoidal input is selected for the oscillatory driving of the rotor relative to the stator.

Figure 8A:
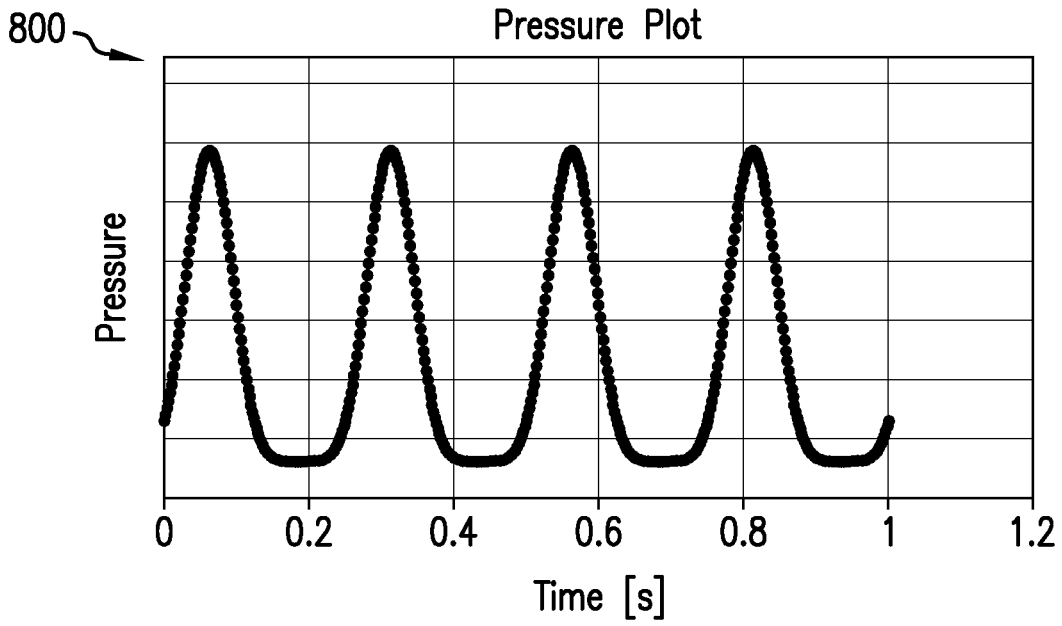
FIG. 8A is a plot of pressure as a function of time of an alternatively configured pulser assembly.

In prior configurations, such as shown and described in U.S. Pat. No. 7,280,432, incorporated herein by reference, using a sinusoidal relation between angular position and time to minimize the mechanical energy demand can lead to a less-than-ideal pressure plot. For example, as shown in FIG. 8A, plot 800 represents a pressure plot similar to that shown in FIG. 6B, but with the operation described in U.S. Pat. No. 7,280,432. The pressure sequence of plot 800 deviates from a single frequency sine pattern, thus creating a weaker pressure transmission signal (signal power is lost in higher frequency content, higher harmonics). It is also noted that for the same pulse actuation frequency (and peak pressure) as used in FIGS. 6A-6B, the position frequency of the prior system is twice that of systems in accordance with the present disclosure, but at half the amplitude. Various prior systems have attempted to address this drawback through the use of unique valve geometries (e.g., U.S. Pat. No. 4,847,815), but such systems suffer other drawbacks, such as unfavorable torque versus closing angle, reduced cross section in the open position, etc. Other solutions may incorporate axial offsets between the stator and the rotor.

Figure 8B:
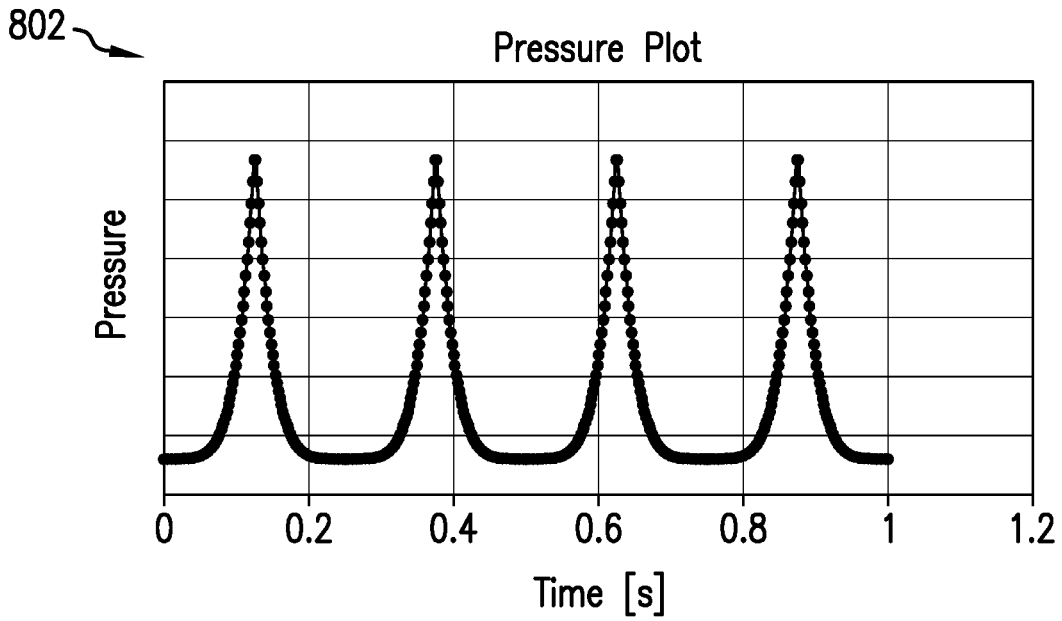
FIG. 8B is a plot of pressure as a function of time of an alternatively configured pulser assembly.

Additionally, some prior configurations operated using an open-to-open oscillation (in contrast to the present close-to-close oscillation). FIG. 8B shows a pressure plot 802 of an open-to-open operation, which has a very large crest factor, with distinct peaks (spikes) of pressure. The spikes occur as the blades or other obstructing element passes over the stator flow passage at the highest velocity (between two open positions). That is, the close state has a very short period, and the open states are where the oscillation changes direction. This results in the pressure plot 802 illustrated in FIG. 8B.

Though such open-to-open operation creates similar pressure drop, there is a resultant significant reduction in transmission signal strength. This is observed when using a sinusoidal angular positioning versus time and the same relation for pressure over closing angle as explained above with respect to FIG. 7. The sharp peaks in pressure shown in FIG. 8B can be explained by the high angular velocity movement through the closed position, as opposed to relatively long exposure at open position during the cyclic reversal (rotor cycle). Due to the non-linear pressure-over-closing angle relation (FIG. 7), the pulse pressure has a very short time period and results in a spike-like pulse. As noted, the crest factor is much higher in plot 802 as compared to the pressure signal of embodiments of the present disclosure (FIG. 6B, plot 602). Further, the open-to-open operation may result in signal attenuation and distortion, lower signal strength, etc.

Such open-to-open systems may be suitable for baseband transmission at a comparable low frequency, preferably with rest positioning at closed valve state, creating a plateau at high pressure. Therefore, the open-to-open sequence would have to be halted in the intermediate position, where, typically, for the case of a sinusoidal drive input, the highest velocity would be. Thus, with deviating from both sinusoidal input as well as deviating from sinusoidal pressure pulse generation, this system would be less suited for high speed mud pulse telemetry systems as enabled by embodiments of the present disclosure. For example, prior open-to-open systems may be typically suitable for operations at up to 2 Hz, whereas the close-to-close operation described herein can enable operations at up to 50 Hz.

The present pulser assemblies and operation thereof can overcome these drawbacks while also providing for increased efficiency of signal transmission (e.g., sinusoidal operation and pressure transmission). That is, by employing a close-to-close oscillation operation, sinusoidal pressure pulses with relatively low crest factor can be achieved. The low crest factor, along with a smooth sine wave (comparing FIG. 6B and FIG. 8), provides for an efficient pressure signal to be generated and thus extracted at the surface.

As noted above, and shown in FIG. 4, a spring may be implemented within the pulser assemblies of the present disclosure (e.g., torsion spring 428). The spring may be a torsion spring with a biasing force that ensures that when the motor is off, the rotor will not block the stator flow passages, and thus a flow path will be maintained in the default or base (middle) position. The spring (e.g., torsion spring 428 shown in FIG. 4) may be configured to ensure the rotor is aligned with the stator and thus opening a maximum flow path through the pulser assembly. The torsion spring can be used to reduce inertia torque and fluid torque, as will be appreciated by those of skill in the art. However, an advantage provided by embodiments of the present disclosure is the open state of the pulser assembly (open flow path) when the motor is off or de-energized. The spring, in some embodiments, can be attached to the rotor shaft and can be a torsion bar (as illustrated in FIG. 4). However, other designs can employ coil springs, magnet springs, or the like.

As noted above, and shown in FIG. 4, a seal may be implemented within the pulser assemblies of the present disclosure (e.g., seal 426). The seal (or seals) may be in the form of flexible bellows and provide sealing and pressure compensation, specifically for a fluid lubricant within a bearing housing and the drilling mud on the exterior of the bearing housing.

With reference to FIG. 4, again, the bearing housing 420 is filled with appropriate lubricant 424 to lubricate the bearings 422 and to pressure compensate an internal cavity of the bearing housing 420 with the downhole pressure of the drilling mud 404. The bearings 422 may be, in some embodiments, typical anti-friction bearings as known in the art and are not described further. In some embodiments, the seal 426 is a flexible bellows seal directly coupled to the rotor shaft 418 and the bearing housing 420. The seal 426 can hermetically seal the lubricant within the bearing housing 420. An angular movement (i.e., oscillating rotation) of the rotor shaft 418 causes the flexible material of the bellows seal 426, in such configurations, to twist. Such twisting can accommodate the angular motion while maintaining the seal. The flexible bellows material may be an elastomeric material, a fiber reinforced elastomeric material, or other suitable material, as will be appreciated by those of skill in the art. In some configurations, it may be necessary to keep the angular rotation relatively small so that the bellows material will not be overstressed by the twisting motion (and thus a relatively larger number of blades/obstructing elements may be employed). In some embodiments, the seal may be formed from an elastomeric rotating shaft seal, a mechanical face seal, a fluid barrier seal, or other similar sealing configurations, as known in the art. In some embodiments, the seal may be achieved using hermetic sealing assemblies, including, without limitation, magnetic clutch devices, that enable transferring the motion through a barrier by means of magnetic torque transfer.

Figure 9:
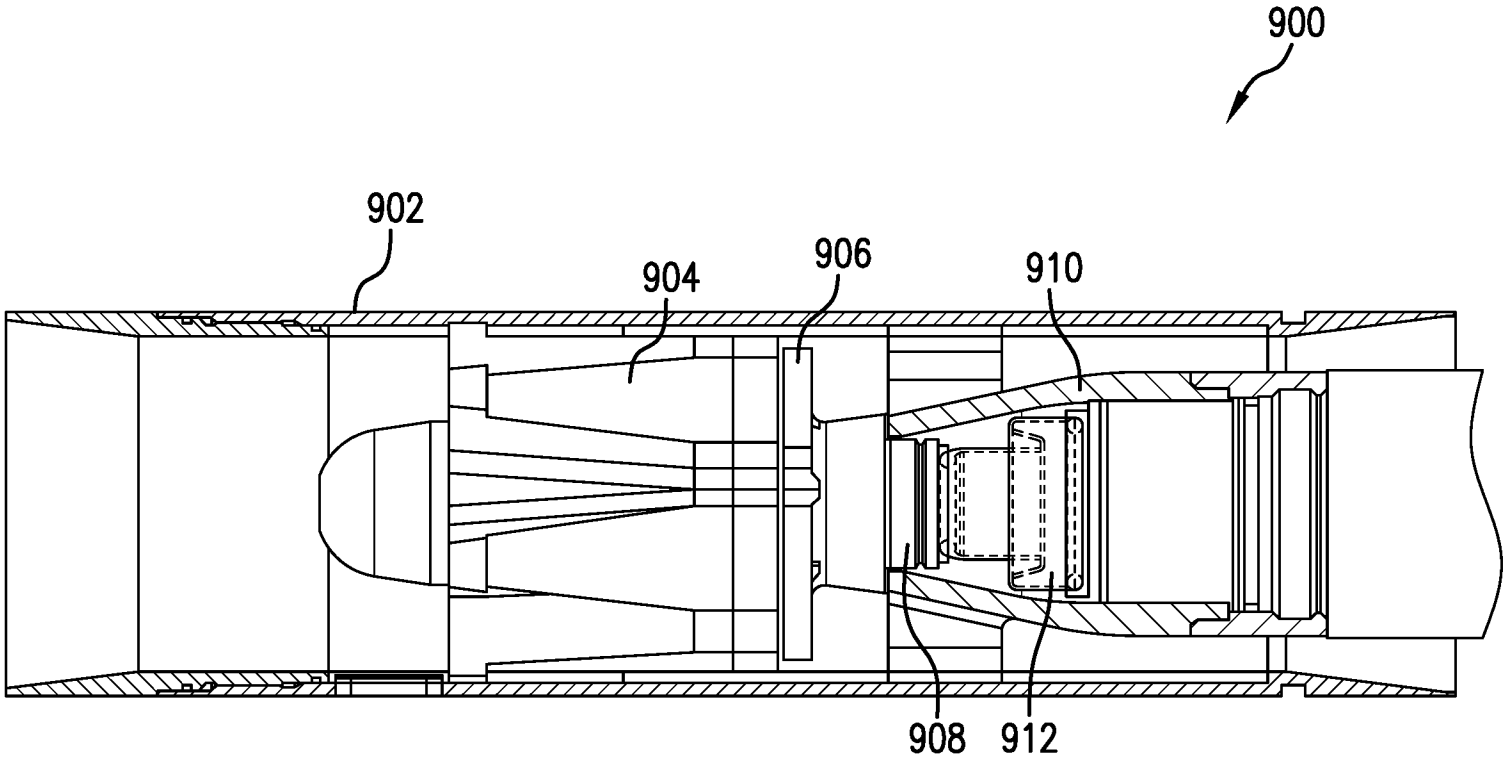
FIG. 9 is a schematic illustration of a pulser assembly in accordance with an embodiment of the present disclosure.

Turning to FIG. 9, a schematic illustration of a pulser assembly 900 in accordance with an embodiment of the present disclosure is shown. The pulser assembly 900 may be operable similar to that described above, with a default or de-energized position that is open, and a driving oscillation between two closed positions. The pulser assembly 900 includes a tool housing 902 through which drilling mud may pass. Arranged within the tool housing 902 is a stator 904 and a rotor 906 arranged relative to the stator 904. The stator 904, in this illustrative embodiment, defines a number of stator flow passages and the rotor includes an equal number of rotor flow passages that are defined between obstructing elements. As described above, when the rotor flow passages are aligned with the stator flow passages, a flow path may be defined such that the drilling mud may flow through the pulser assembly 900. In operation, the rotor 906 may be rotatably driven by a motor to have one or more obstructing elements that will block (partially or wholly) the stator flow passages to reduce or prevent a flow of the drilling mud through the pulser assembly 900.

A rotor shaft 908 is configured to be driven by the motor and is operably connected to the rotor 906. The rotor shaft is housed, at least partially, within a bearing housing 910, which contains one or more bearings that can support the rotor shaft 908. The bearing housing 910 is filled with a lubricant to aid rotation of the rotor shaft 908 within the bearing housing 910. A seal 912 is arranged between the bearing housing 910 and the rotor shaft 908. The seal 912 may be a bellows seal that is fixedly attached to the bearing housing 910 and sealingly engages with a surface of the rotor shaft 908. The seal 912 may be made of an elastomeric or other flexible material that allows for the rotation of the rotor shaft 908 relative to the seal 912, while maintaining the sealing contact therebetween. The seal 912 may provide for double the rotation angle as compared to prior bellows seals.

Figure 10:
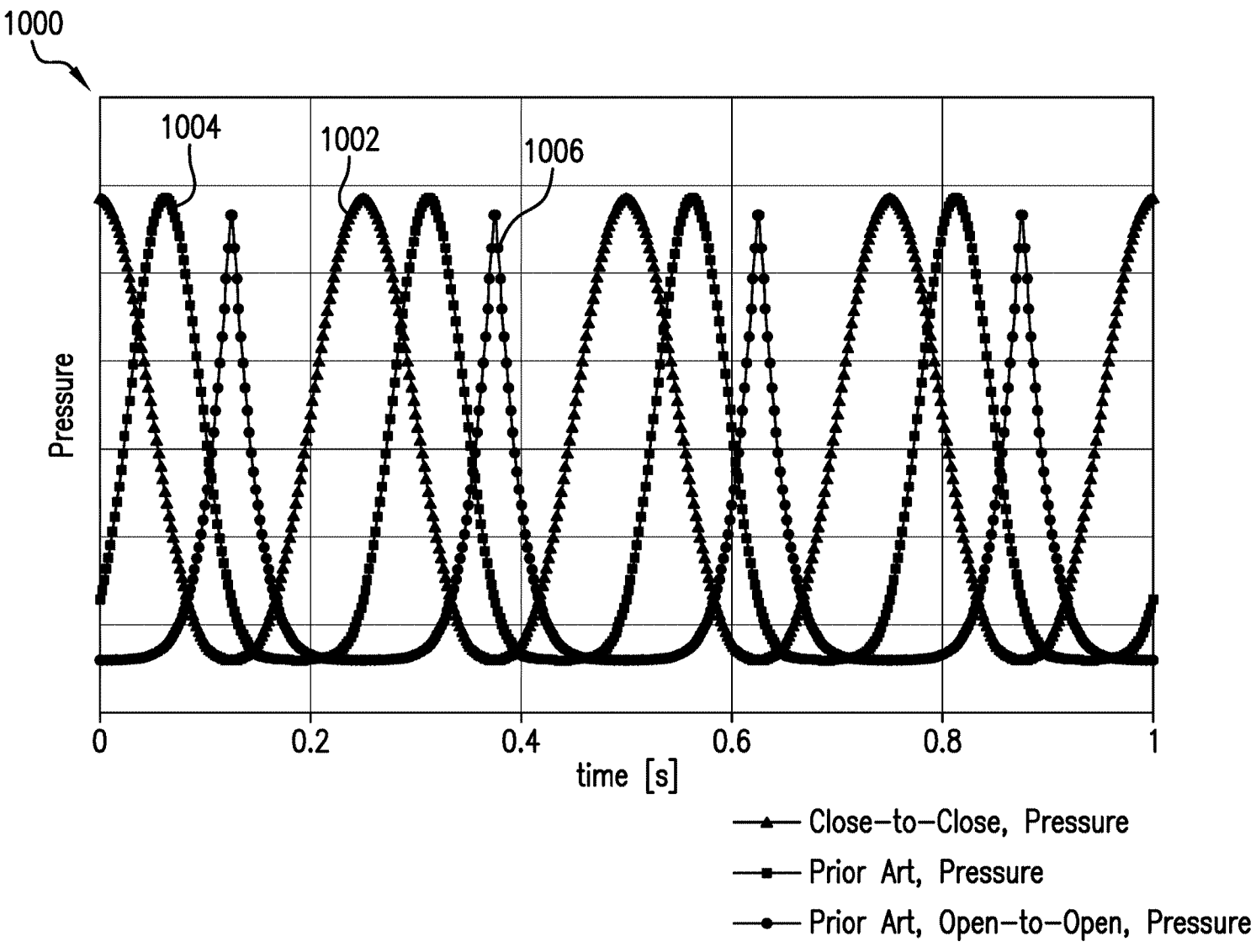
FIG. 10 is a plot of pressures illustrating different pressure curves based on different pulser configurations.

Turning now to FIG. 10, a schematic pressure plot 1000 comparing different oscillating systems is shown. The oscillating systems that are illustrating in pressure plot 1000 employ a similar sinusoidal drive input, such as displayed in FIG. 6A and considering the pressure versus angle relation as displayed in FIG. 7. The pressure plot 1000 includes a close-to-close oscillation system (disclosed herein) as illustrated by pressure curve 1002, a half-oscillation system (prior art) as illustrated by pressure curve 1004, and an open-to-open oscillation system (prior art) as illustrated by pressure curve 1006.

The close-to-close pressure curve 1002 is closest to a clean sinusoidal pressure curve. As such, only a few higher harmonics with relatively low amplitudes would be needed to reconstruct the signal at the surface. The frequency content of this pressure curve 1002 will remain low, with most of the energy being in the base frequency, and thus not suffering much from bandwidth limitations. Further, the crest factor is very close to the crest factor of a sine function. Accordingly, signal transmission will be close to optimum. Due to the small energy in the few higher harmonics (ideally none) leads to most (ideally all) pressure energy (hydraulic energy) generated by the pulser assembly to be concentrated in the carried frequency (base frequency) of the pressure signal. With prior systems, with pressure curves deviating from a sinusoidal shape, energy would be captured in higher harmonics. As higher frequency pressure waves experience more damping on the travel through the mud column to surface, energy is lost, leading to more difficultly in detecting pressure signals at surface and lower decoding quality.

In contrast, the half-oscillation system, shown by pressure curve 1004, has a pressure signal that is not a clean sinusoidal pulsation (more peaked, and longer spaces between peaks due to extended low pressure periods). As such, reconstruction at the surface requires use of additional higher harmonics, as compared to the harmonics required for reconstruction of pressure curve 1002. The harmonics would decline slower than in the pressure curve 1002. Frequency content in higher frequency is no longer negligible. That is, the overall energy content is not solely concentrated on the base frequency. To reconstruct the signal from the pressure curve 1004, some bandwidth is needed for the higher harmonics. This results in the crest factor of the pressure curve 1004 being higher than of a clean sine signal (e.g., pressure curve 1002).

The pressure curve 1006 of the open-to-open oscillation operation is not close to a sinusoid shape. The crest factor of this pressure curve 1006 is high compared to both other pressure curves 1002, 1004. To reconstruct the signal from the pressure curve 1006, significant higher harmonics with high amplitudes are required. The bandwidth used for reconstruction is significant, with higher harmonic content dominating the signal. Furthermore, noise over a wide range of frequencies would be a consequence, resulting in poor signal transmission quality.

Figure 11A:
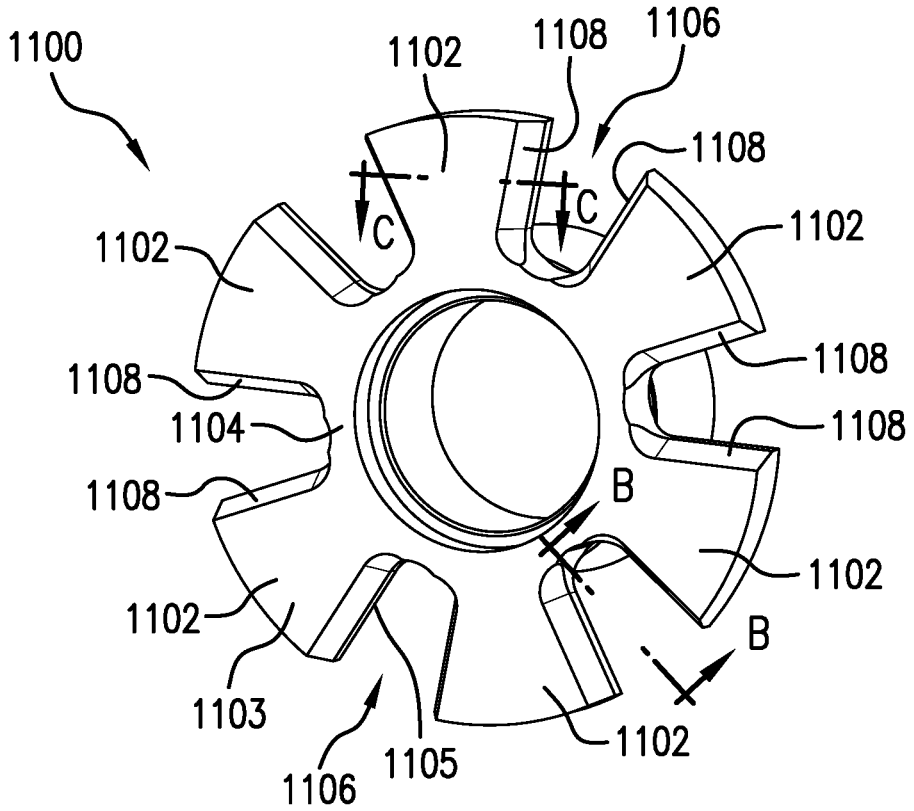
FIG. 11A is a schematic illustration of a rotor of a pulser assembly in accordance with an embodiment of the present disclosure.
Figure 11B:
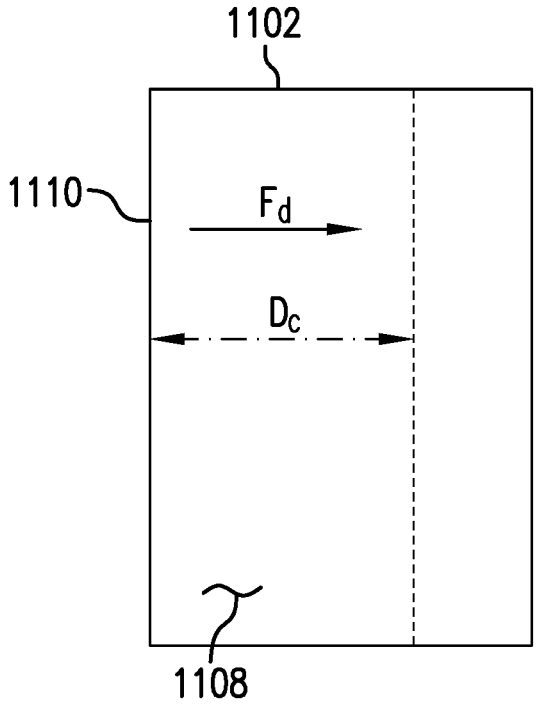
FIG. 11B is a side elevation view of an obstructing element of the rotor of FIG. 11A as viewed along the line B-B shown in FIG. 11A.
Figure 11C:
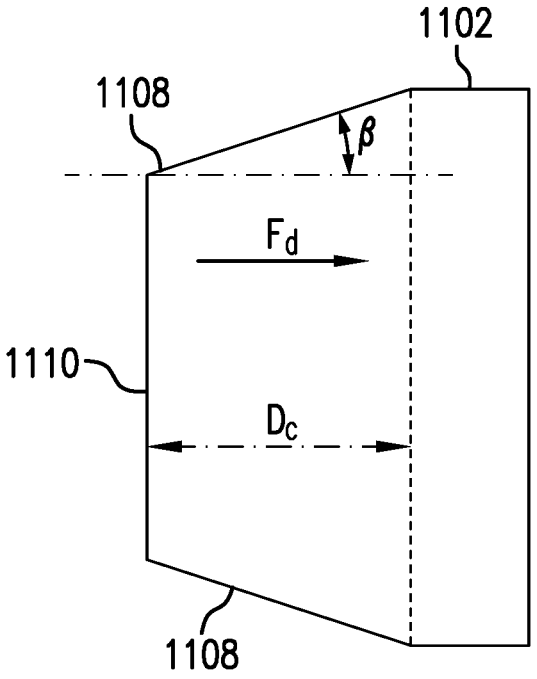
FIG. 11C is a cross-sectional view of an obstructing element of the rotor of FIG. 11A as viewed along the line C-C shown in FIG. 11A.
Figure 13A:
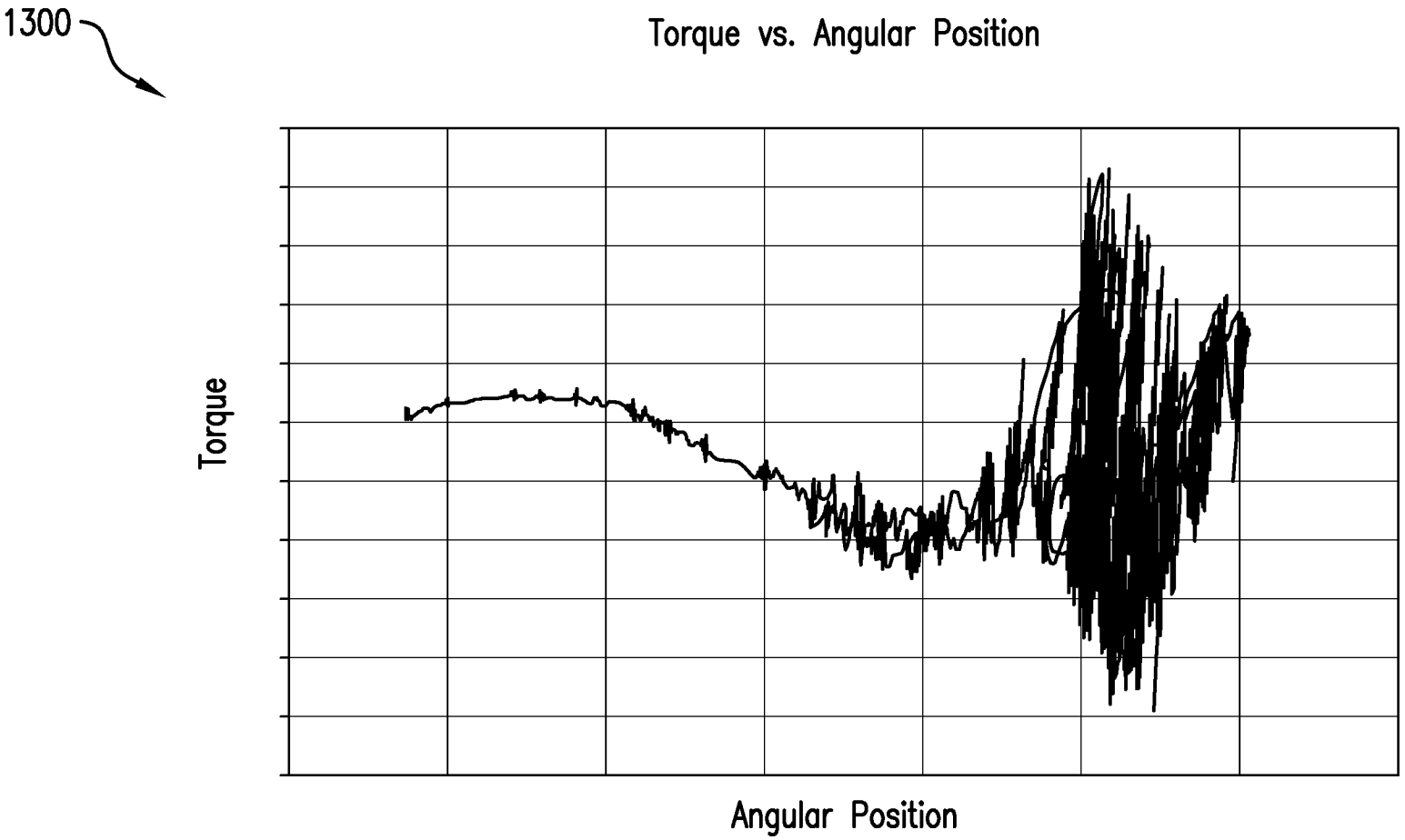
FIG. 13A is a plot of torque as a function of angular position of a pulser assembly.

Turning now to FIGS. 11A-11C, schematic illustrations of a rotor 1100 to be used with a pulser assembly in accordance with an embodiment of the present disclosure are shown. The rotor 1100 is configured to enable a reduction in the overall power demand for pulse pressure generation. In operation, hydraulic torque (fluidic torque) is generated by the flowing fluid (drilling mud). Hydraulic torque curves can reach high torque values, especially at high flow rates, high fluid density, and toward a closed position (i.e., obstructing element blocking a flow path). Further, fluidic torque can experience an unstable behavior with high changes in torque values even with minimal changes in position of the relative components. Such unstable torque (e.g., galloping instability, as shown in FIG. 13A) can result close to the closed position.

To address such instability, the rotor 1100 is configured such that a more stable opening torque is achieved close to the closed position. The rotor 1100 includes a plurality of blocking elements 1102 distributed about a hub 1104 and extending from the hub 1104. The hub 1104 may be configured to operably connect to a rotor shaft of a pulser assembly to enable a driving rotation of the rotor 1100. Between adjacent obstructing elements 1102 are defined rotor flow passages 1106 through which a drilling mud may pass. The obstructing elements 1102 are sized and shaped to provide for selective blocking or obstructing a fluid flow through a stator flow passage, as described above.

The obstructing element 1102 are configured with chamfered sidewalls 1108 or edges. The sidewall refers to a side of the rotor defining the rotor flow passage. The chamfered sidewalls 1108 are angled such that an upstream side 1103 of the rotor flow passage 1106 has a larger cross-section than a downstream side 1105 of the rotor flow passage 1106. That is, the rotor flow passages 1106 have narrowing geometry in a flow direction through the rotor flow passages 1106. The chamfered sidewalls 1108 provide upstream facing chamfers or surfaces (i.e., facing toward a flowing fluid) to deviate the direction from the fluid flow and to create an opening torque. This is particularly useful when the rotor 1100 is approaching a closed position (i.e., the obstructing elements 1102 align with or substantially cover a stator flow passage). In the open position of a flow path through a stator and rotor, the obstructing elements 1102 do not block the stator flow passages, and thus have no impact on the rotor 1100 (i.e., the chamfered sidewalls 1108 are not exposed to the flowing fluid). However, as the rotor 1100 rotates toward a closed position, a chamfer opening torque effect will increase. The size, angle, and other geometry of the chamfered sidewalls 1108 may result in establishing a desired torque profile. In some embodiments, the chamfer may include a bevel, a fillet, or a groove.

FIG. 11B illustrates a side elevation view of a blocking element 1102 of the rotor 1100, such as shown along the view B-B in FIG. 11A. FIG. 11C illustrates a cross-sectional view of a blocking element 1102 of the rotor 1100, such as shown along the view C-C in FIG. 11A. As shown in FIG. 11B, a flow direction $F_d$ is to the right on the page, and thus the blocking element 1102 has an upstream face 1110 that is at the upstream end of the blocking element 1102. From the upstream face 1110, the blocking element 1102 has a chamfer depth $D_c$. The chamfer depth $D_c$ is a length or depth of the chamfer sidewall 1108 from the upstream face 1110 in the flow direction $F_d$. Further, as shown in FIG. 11C, the chamfer sidewall 1108 has a chamfer angle β. That is, the chamfer sidewall 1108 is angled at the chamfer angle β in the flow direction $F_d$. In accordance with some non-limiting embodiments, the chamfer angle β may be between about 5° and about 45°, and the chamfer depth $D_c$ may be between about 2 mm and about 10 mm. These are merely example dimensions of the obstructing element and the chamfer sidewalls thereof, in accordance with some example embodiments of the present disclosure, and are not intended to be limiting.

Turning now to FIGS. 12A-12D, schematic illustrations of an operation of a pulser assembly 1200 in accordance with an embodiment of the present disclosure are shown. The pulser assembly 1200 includes a stator 1202 and a rotor 1204, similar to that shown and described above. The rotor 1204 includes a plurality of obstructing elements 1206, with each obstructing element 1206 having chamfered sidewalls 1208 (e.g., as shown and described in FIGS. 11A-11C). In FIGS. 12A-12D, a flow direction 1210 is to the right on the page, such that the rotor 1204 is arranged downstream from the stator 1202. As such, and as illustrated, the chamfered sidewalls 1208 face upstream and may be directly impacted and acted upon by a fluid flow.

Figure 12A:
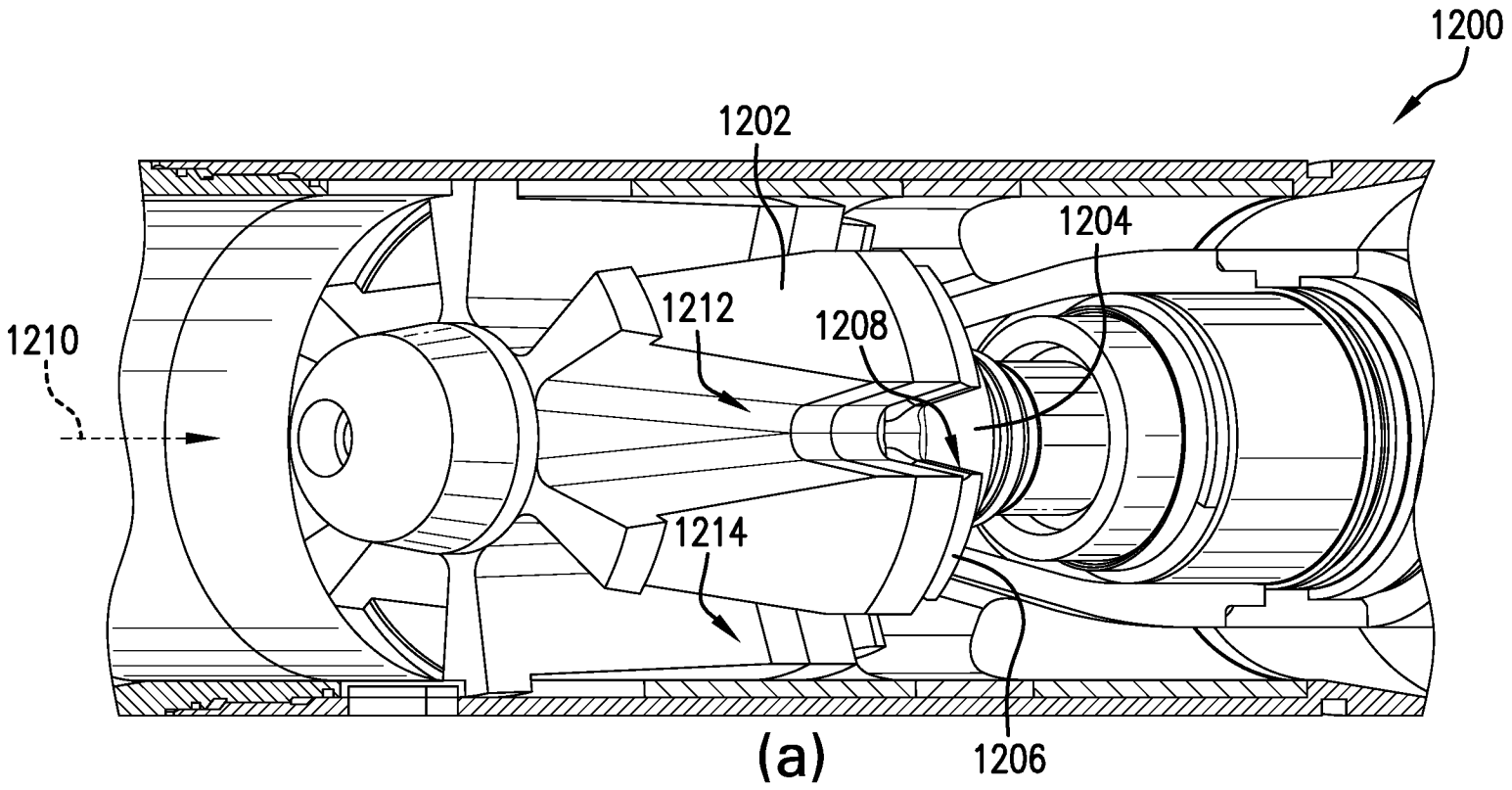
FIG. 12A is a schematic illustration of a pulser assembly in accordance with an embodiment of the present disclosure, shown in a starting orientation, illustrating a transition from an open position to a first closed position.
Figure 12B:
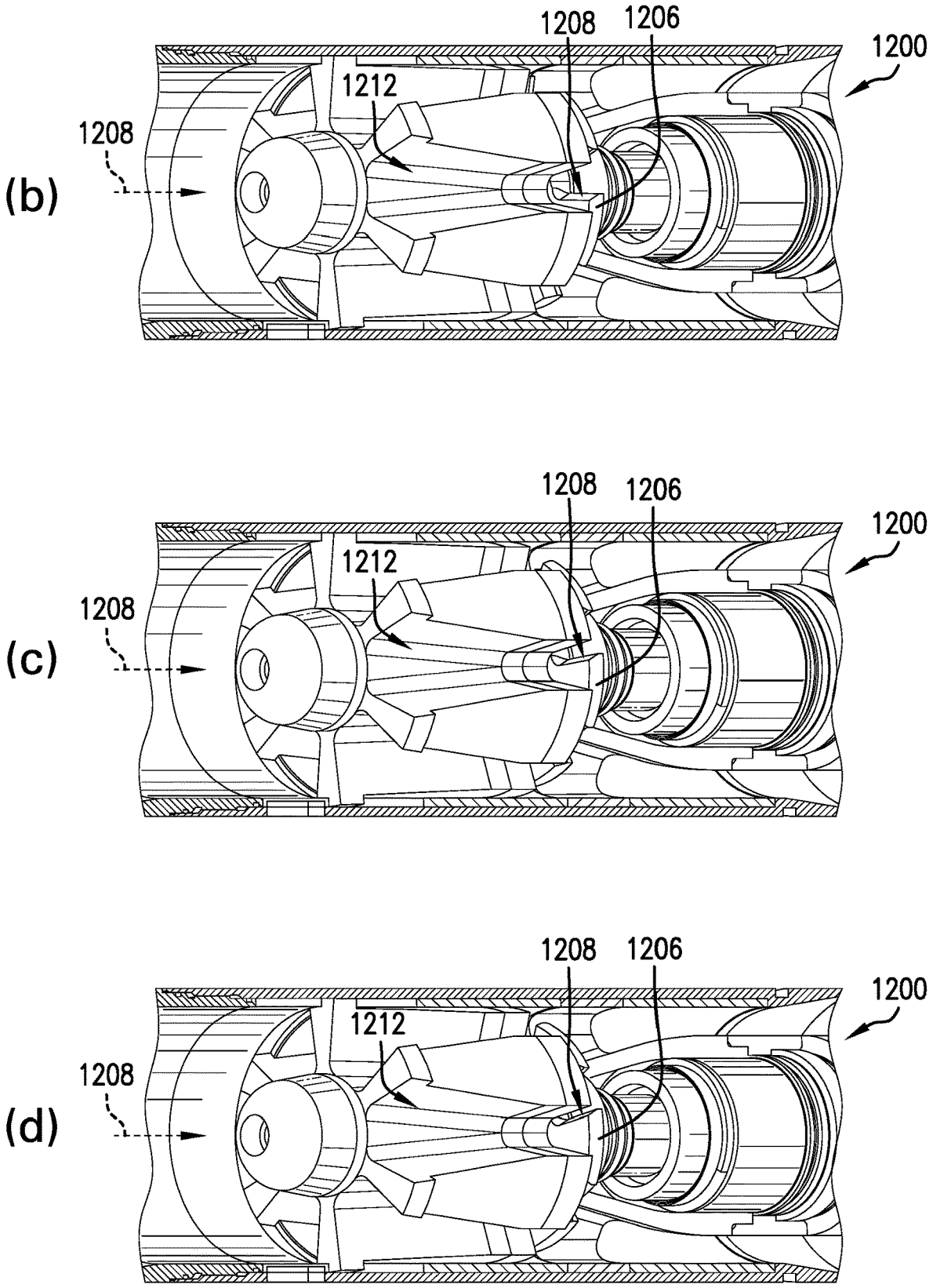
FIG. 12B illustrates a series of orientations of operation of the pulser assembly of FIG. 12A, illustrating a transition from the first closed position back to and through the open position.

FIG. 12A illustrates the pulser assembly 1200 in a starting state (orientation (a)), with the obstructing elements 1206 not blocking or otherwise obstructing flow through stator flow passages 1212, 1214. FIG. 12B illustrates a sequence of orientations (b) through (d) that illustrate a transition or partial oscillation of the obstructing element 1206 as it rotates to obstruct flow through a first stator flow passage 1212. That is, orientations (b) through (d) illustrate an open-to-close (first closed) state of the pulser assembly 1200. As the obstructing element 1206 is rotated, the chamfered sidewall will become exposed to the fluid flow, and such fluid flow will impart a normal force (i.e., an opening torque) upon the surface that is counter to the direction of rotation (i.e., in a direction to move the obstructing element 1206 back to the open state of the first stator flow passage 1212). Orientation (d) represents the maximum extent of rotation of the obstructing element 1206 as it obstructed flow through the first stator flow passage 1212. At orientation (d) the rotational velocity of the rotor 1204 is zero, and a rotational direction change occurs, as described above.

Figure 12C:
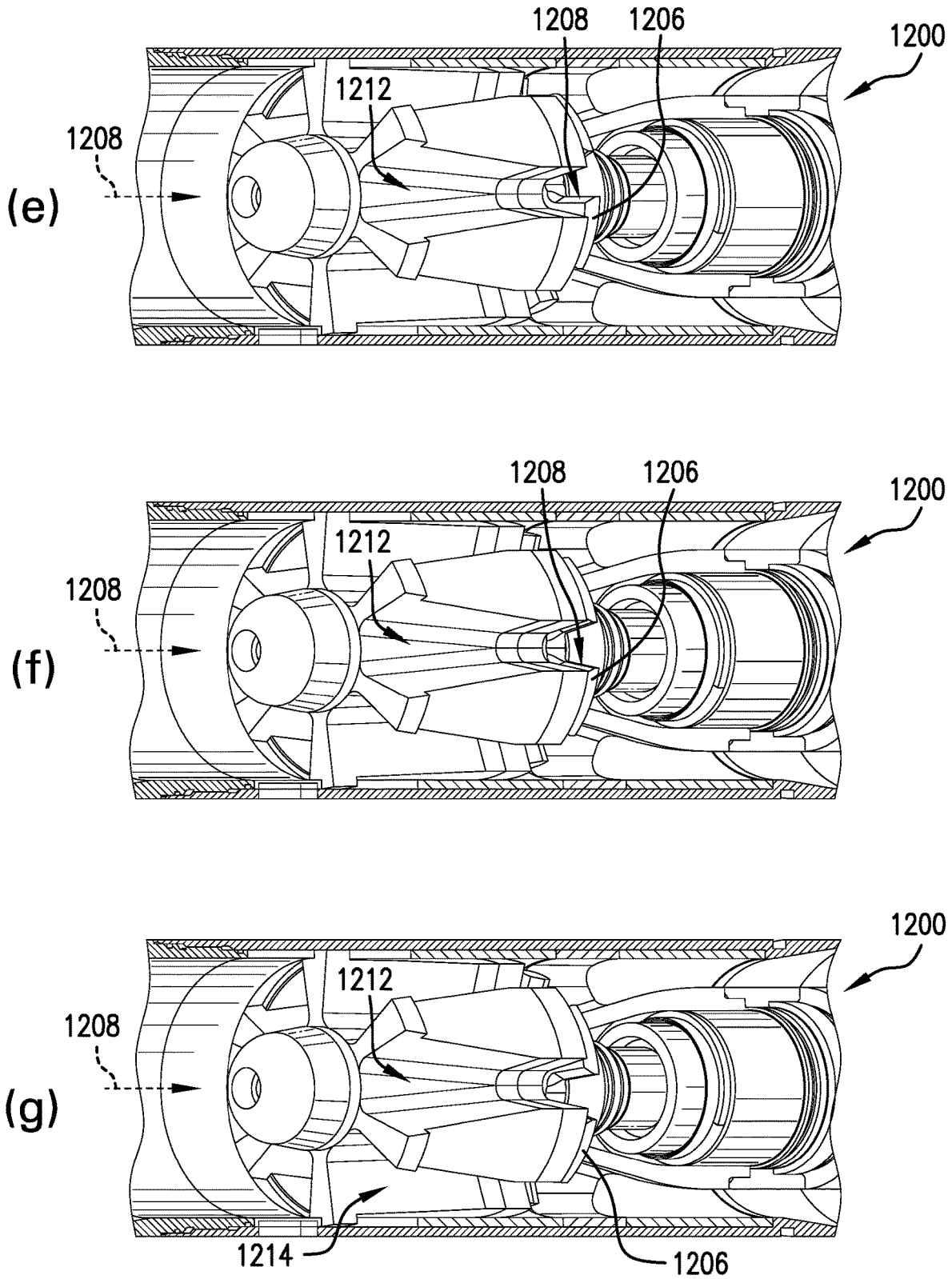
FIG. 12C illustrates a series of orientations of operation of the pulser assembly of FIG. 12A, illustrating a transition from a low obstructing position to a second closed position.

FIG. 12C illustrates orientations (e) through (g) which represent the change in rotational direction of the obstructing element 1206 due in part to a change in rotor rotation and aided by the force (opening torque) applied by the fluid flow against the chamfered sidewall 1208. Orientation (f) of FIG. 12C illustrates the obstructing element 1206 back at the open state of the first stator flow passage 1212, with no obstruction of the flow therethrough. Because this is during an oscillation of the pulser assembly 1200, the obstructing element 1206 is rotating at a maximum rotational velocity through this position. Orientation (g) illustrates the obstructing element 1206 continuing to travel in the rotational direction of the sequence of orientations (e) through (g), such that the obstructing element 1206 is traveling to a position to obstruct a second stator flow passage 1214. The second closed state is illustrated by the sequence of orientations (h) through (j) shown in FIG. 12D, where orientation (j) represents a second closed state of the pulser assembly 1200. At this position, the rotational velocity of the rotor is zero, and the fluid flow will apply a force (opening torque) upon the obstructing element 1206 at the chamfered sidewall

1208 such that the obstructing element 1206 will reverse direction and travel back toward the open state shown in orientations (a) or (f).

Figure 12D:
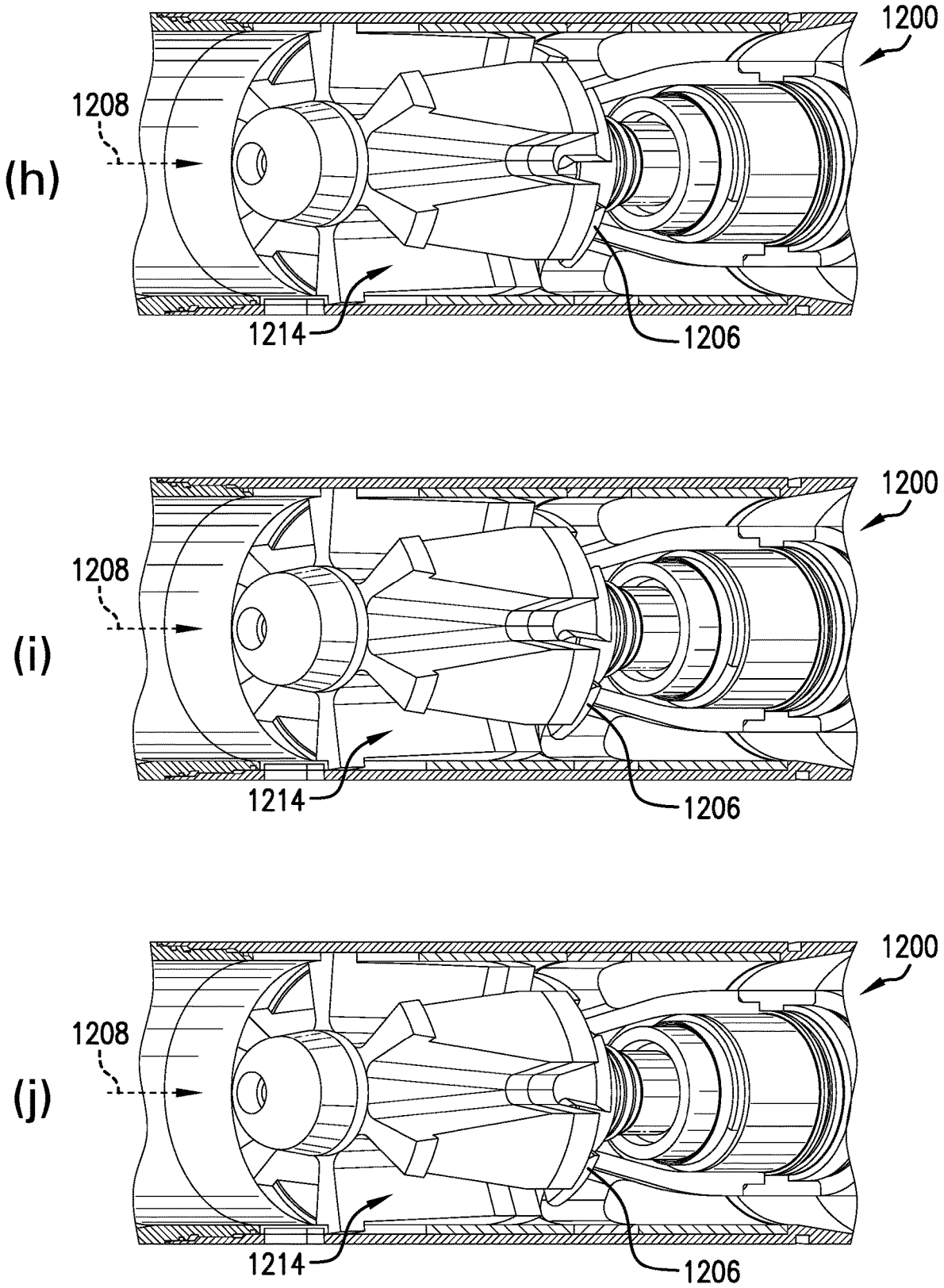
FIG. 12D illustrates a series of orientations of operation of the pulser assembly of FIG. 12A.

As detailed above and shown in FIG. 12A-D, the obstructing elements may be larger than the opening of the stator flow passage. That is, in some non-limiting embodiments, the angular arc or extent of an obstructing element may be greater than the angular arc or extent of a respective opening of a respective stator flow passage. For the operation cycle as shown in FIGS. 12B-D, the larger angular rotor arc supports the function of the chamfered sidewall 1208. Although both sides of the rotor obstruction elements 1206 may have chamfered sidewalls, the chamfered sidewall on the closing side of the rotor provides the increased opening torque toward the obstructing positions. During such operation, the other chamfered sidewall is hidden behind the stator obstruction element, hence creating substantially less or no hydraulic torque. In some embodiments, if the circumferential (arc) width of the obstructing element is selected to be similar to a stator flow passage opening arc, both of the obstructing element chamfered sidewalls would become effective in the fully obstructed (or close to fully obstructed) position. As such, in some such configurations, when both chamfered sidewalls are exposed at the same time, the opening torque may be effectively canceled or unstable (i.e., the effects of both chamfered sidewalls may cause a neutral torque that cancels out when both sides are equally exposed at the same time). For example, in some instances and at certain flow rates and fluid velocity, fluidic torque instabilities as shown in FIG. 13A may occur. Therefore, obstructing elements having larger arc widths than the opening of the stator flow passage can provide significant advantages as opposed to alternative configurations. In one embodiment, the chamfered sidewall on the closing side may be hidden behind the stator obstruction element in the closed state of the pulser assembly. That is, the chamfered sidewall may completely disappear behind the stator obstruction element. In another embodiment, the chamfered sidewall on the closing side may remain at least partially effective in the closed state of the pulser assembly. That is, the chamfered sidewall may be at least partially exposed in the closed state of the pulser assembly.

In some embodiments, the chamfer may extend from the upstream face of the rotor to the downstream face of the rotor. In other embodiments, the chamfer may extend only over a portion of the sidewall between the upstream face and the downstream face of the rotor. As such, the chamfer may start at the upstream face but does not extend to the downstream face or the chamfer may start at a distance from the upstream face and end a distance from the downstream face. The chamfer not extending to the downstream face results in higher mechanical stability and may prevent material erosion because the chamfer does not end in a small edge at the downstream face.

Hydraulic torque may be affected by various factors and elements, related to the fluid flow and the arrangement of elements of the pulser assembly. For example, without limitation, some factors related to the pulser assembly may include a rotary position of the rotor and/or an obstructing element, an axial gap distance between the stator and the rotor, a radial gap between an outer diameter of an obstructing element (or rotor edge) and an inside of a tool housing, an obstructing element width, a chamfer design and size, an obstructing element backside (downstream) geometry, any reinforcement structures, a rotor hub diameter, the number of rotor flow passages (and thus flow paths through the pulser assembly), an outer diameter of the pulser assembly, and an effective lever arm of obstructing elements. Further, some example, factors related to the fluid passing through the pulser assembly may include, without limitation, a pressure drop across the rotor, a flow rate of the drilling mud and a fluid density.

Figure 13B:
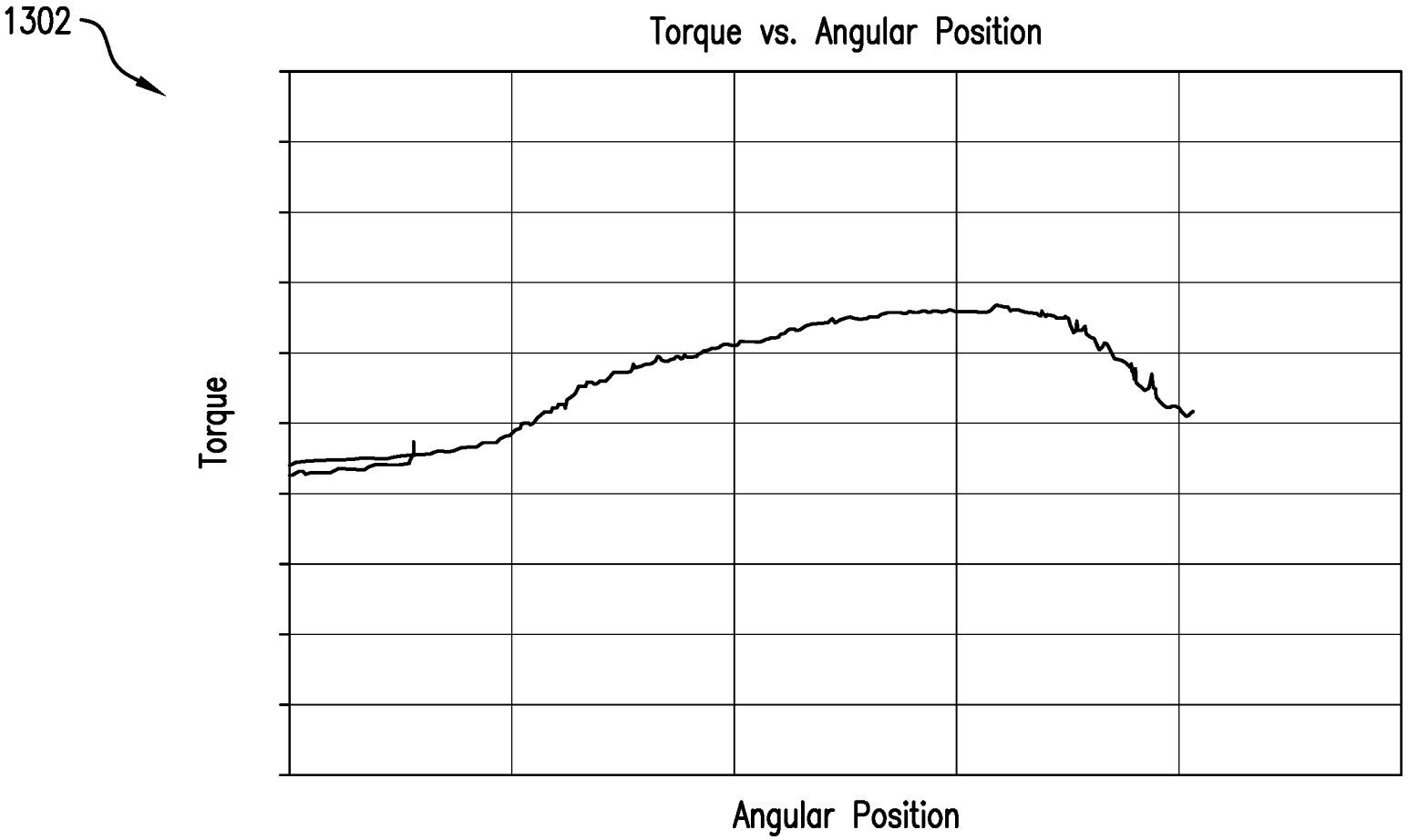
FIG. 13B is a plot of torque as a function of angular position of a pulser assembly incorporating an embodiment of the present disclosure.

Turning to FIGS. 13A-13B, schematic plots illustrate the difference between a rotor having straight sidewalls (i.e., no chamfer) in plot 1300 of FIG. 13A, as compared to a rotor having chamfered sidewalls in plot 1302 of FIG. 13B. Plot 1300 illustrates the instability of the torque as an angular position increased (i.e., toward a closed position) of a rotor without such chamfered sidewalls. In contrast, plot 1302 illustrates a relatively smooth torque curve due to the chamfered sidewalls incorporated into the rotor (e.g., as shown in FIGS. 11A-11C and FIG. 12).

Embodiment 1: A method for generating pulses in a drilling fluid, the method comprising: driving rotation of a rotor relative to a stator of a pulser assembly in an oscillatory manner, wherein the pulser assembly comprises a tool housing arranged along a drill string and the stator and the rotor are arranged within the tool housing, wherein the stator comprises at least one stator flow passage to allow drilling fluid flow therethrough and the rotor comprises at least one rotor flow passage to allow drilling fluid flow therethrough and at least one obstructing element configured to selectively obstruct a fluid flow through the at least one stator flow passage, wherein the oscillatory manner comprises: rotating the at least one obstructing element from a middle position to a first blocking angle position such that a first selective obstruction of the at least one stator flow passage by the at least one obstructing element occurs, wherein, the middle position is defined by a minimum of obstruction by the at least one obstructing element of a flow through the at least one stator flow passage; and rotating the at least one obstructing element from the first blocking angle position to a second blocking angle position such that a second selective obstruction of the at least one stator flow passage by the at least one obstructing element occurs, wherein rotation of the at least one obstructing element selectively obstructs the at least one stator flow passage when drilling fluid is flowing through the drill string to generate a pressure pulse in the drilling fluid, and wherein the oscillatory manner is an oscillation of the at least one obstructing element between the first blocking angle position and the second blocking angle position such that at the first and second blocking angle position a direction of rotation of the rotor is changed.

Embodiment 2: The method of any preceding embodiment, wherein the rotation of the at least one obstructing element from the first blocking angle position to the second blocking angle position includes passing through the middle position.

Embodiment 3: The method of any preceding embodiment, wherein a maximum rotational velocity of the rotor is reached at the middle position.

Embodiment 4: The method of any preceding embodiment, wherein a minimum rotational velocity of the rotor is reached at the first blocking angle position and the second blocking angle position.

Embodiment 5: The method of any preceding embodiment, further comprising biasing the rotor to maintain the at least one obstructing element in about the middle position such that the at least one stator flow passage is open for the passage of the drilling fluid.

Embodiment 6: The method of any preceding embodiment, further including driving rotation of the rotor to overcome a biasing force of a biasing element to drive the at least one obstructing element toward at least one of the first blocking angle position and the second blocking angle position.

Embodiment 7: The method of any preceding embodiment, wherein the at least one obstructing element comprises a chamfered sidewall.

Embodiment 8: The method of any preceding embodiment, wherein the chamfered sidewall extends from an upstream face of the at least one obstructing element to a chamfer depth.

Embodiment 9: The method of any preceding embodiment, wherein the chamfer depth is between about 2 mm and about 10 mm.

Embodiment 10: The method of any preceding embodiment, wherein the chamfered sidewall extends from an upstream face of the at least one obstructing element at a chamfer angle.

Embodiment 11: The method of any preceding embodiment, wherein the chamfer angle is between about 5° and about 45°.

Embodiment 12: The method of any preceding embodiment, further comprising transmitting downhole information from the pulser assembly using at least one of Amplitude Shift Keying (ASK), Frequency Shift Keying (FSK), Pulse Position Modulation (PPM), Quadrature Phase Shift Keying (QPSK), and Phase Shift Keying (PSK).

Embodiment 13: The method of any preceding embodiment, wherein the pressure pulse has a sinusoidal pressure profile.

Embodiment 14: The method of any preceding embodiment, further comprising adjusting at least one of a first blocking angle of the first blocking angle position and a second blocking angle of the second blocking angle position to adjust an amplitude of the pressure pulse.

Embodiment 15: The method of any preceding embodiment, wherein the pulser assembly comprises a single stator flow passage and a single obstructing element.

Embodiment 16: The method of any preceding embodiment, further comprising receiving a downlink that includes operation instructions for driving rotation of the rotor.

Embodiment 17: The method of any preceding embodiment, wherein the rotor is arranged downstream from the stator.

Embodiment 18: The method of any preceding embodiment, wherein the oscillatory manner is driven by one of a reversible brushless DC motor, a servomotor, or a stepper motor.

Embodiment 19: The method of any preceding embodiment, wherein the pulser assembly comprises four stator flow passages and four rotor flow passages.

Embodiment 20: A rotary pulser configured to be positioned along a drill string through which a drilling fluid flows, the rotary pulser comprising: a housing configured to be supported along the drill string; a stator supported by the housing, the stator having at least one stator flow passage that extends from an upstream end to a downstream end of the stator; a rotor positioned adjacent the stator, the rotor including at least one obstructing element, the rotor rotatable to selectively obstruct the at least one stator flow passage with the at least one obstructing element; a motor coupled to the rotor, wherein the motor assembly is operable to rotate the rotor relative to the stator; and a controller configured to drive the motor and rotate the rotor relative to the stator, wherein the controller is configured to drive rotation of the rotor in an oscillatory manner such that: a first selective obstruction of the at least one stator flow passage by the at least one obstructing element occurs when the obstructing element is rotated from a middle position to a first blocking angle position, wherein, the middle position is defined by a minimum of obstruction by the obstructing element of a flow through the at least one stator flow passage, a second selective obstruction of the at least one stator flow passage by the at least one obstructing element occurs when the obstructing element is rotated from the first blocking angle position to a second blocking angle position, wherein rotation of the obstructing element selectively obstructs the at least one stator flow passage when drilling fluid is flowing through the drill string to generate a pressure pulse in the drilling fluid, and wherein the oscillatory manner is an oscillation of the at least one obstructing element between the first blocking angle position and the second blocking angle position such that at the first and second blocking angle position a direction of rotation of the rotor is changed.

Embodiment 21: The rotary pulser of any preceding embodiment, wherein a maximum rotational velocity of the rotor is reached at the middle position.

Embodiment 22: The rotary pulser of any preceding embodiment, wherein a minimum rotational velocity of the rotor is reached at the first blocking angle position and the second blocking angle position.

Embodiment 23: The rotary pulser of any preceding embodiment, further comprising a biasing element configured to maintain the at least one obstructing element in about the middle position such that the at least one stator flow passage is open for the passage of the drilling fluid.

Embodiment 24: The rotary pulser of any preceding embodiment, wherein the motor is configured to overcome a biasing force of the biasing element to drive the at least one obstructing element toward at least one of the first blocking angle position and the second blocking angle position.

Embodiment 25: The rotary pulser of any preceding embodiment, wherein the biasing element is a torsion bar.

Embodiment 26: The rotary pulser of any preceding embodiment, wherein the at least one obstructing element comprises a chamfered sidewall.

Embodiment 27: The rotary pulser of any preceding embodiment, wherein the chamfered sidewall extends from an upstream face of the at least one obstructing element to a chamfer depth.

Embodiment 28: The rotary pulser of any preceding embodiment, wherein the chamfer depth is between about 2 mm and about 10 mm.

Embodiment 29: The rotary pulser of any preceding embodiment, wherein the chamfered sidewall extends from an upstream face of the at least one obstructing element at a chamfer angle.

Embodiment 30: The rotary pulser of any preceding embodiment, wherein the chamfer angle is between about 5° and about 45°.

Embodiment 31: The rotary pulser of any preceding embodiment, further comprising a rotor shaft operably connecting the motor to the rotor.

Embodiment 32: The rotary pulser of any preceding embodiment, further comprising a bearing housing, wherein the rotor shaft extends through the bearing housing.

Embodiment 33: The rotary pulser of any preceding embodiment, further comprising one or more seals fixedly connected to the bearing housing and in sealing contact with the rotor shaft.

Embodiment 34: The rotary pulser of any preceding embodiment, wherein the controller is configured to employ at least one of Amplitude Shift Keying (ASK), Frequency Shift Keying (FSK), Pulse Position Modulation (PPM), Quadrature Phase Shift Keying (QPSK), and Phase Shift Keying (PSK).

Embodiment 35: The rotary pulser of any preceding embodiment, wherein the pressure pulse has a sinusoidal pressure profile.

Embodiment 36: The rotary pulser of any preceding embodiment, wherein the controller is configured to adjust at least one of a first blocking angle of the first blocking angle position and a the second blocking angle of the second blocking angle position to adjust an amplitude of the pressure pulse.

Embodiment 37: The rotary pulser of any preceding embodiment, wherein the stator comprises a single stator flow passage and the rotor comprises a single obstructing element.

Embodiment 38: The rotary pulser of any preceding embodiment, wherein the controller is configured to receive a downlink that includes operation instructions for driving rotation of the rotor.

Embodiment 39: The rotary pulser of any preceding embodiment, wherein the rotor is arranged downstream from the stator.

Embodiment 40: The rotary pulser of any preceding embodiment, wherein the motor is one of a reversible brushless DC motor, a servomotor, or a stepper motor.

Embodiment 41: The rotary pulser of any preceding embodiment, further comprising at least one pressure sensor arranged to monitor a pressure of the pressure pulse.

Embodiment 42: The rotary pulser of any preceding embodiment, comprising four stator flow passages and four rotor flow passages.

Embodiment 43: The rotary pulser of any preceding embodiment, wherein a reversal point of oscillation is at each of the first blocking angle position and the second blocking angle position.

The systems and methods described herein provide various advantages. For example, embodiments provided herein enable improved and more efficient data transfer through mud pulse telemetry than prior systems and methods. For example a more defined and more easily reconstructed signals may be generated. A close-to-close operation provides for a clean sinusoidal signal as compared to prior configurations that generated higher crest factor signals. Moreover, chamfered sidewalls on obstructing elements may provide for a more smooth operation that minimizes torque instability, particularly when the pulser assembly is close to the closed state.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements.

There may be many variations or steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for generating a pressure pulse in a drilling fluid, the method comprising:

driving rotation of a rotor relative to a stator of a pulser assembly in an oscillatory manner, wherein the pulser assembly comprises a tool housing arranged along a drill string and the stator and the rotor are arranged within the tool housing, wherein the stator comprises at least one stator flow passage to allow drilling fluid flow therethrough and the rotor comprises at least one rotor flow passage to allow drilling fluid flow therethrough and at least one obstructing element configured to selectively obstruct the drilling fluid flow through the at least one stator flow passage, wherein the oscillatory manner comprises:

rotating the at least one obstructing element from a middle position to a first blocking angle position such that a first selective obstruction of the at least one stator flow passage by the at least one obstructing element occurs, wherein, the middle position is defined by a minimum of obstruction by the at least one obstructing element of the drilling fluid flow through the at least one stator flow passage; and rotating the at least one obstructing element from the first blocking angle position to a second blocking angle position such that a second selective obstruction of the at least one stator flow passage by the at least one obstructing element occurs, wherein the rotation of the at least one obstructing element occurs at a rotational velocity and selectively obstructs the at least one stator flow passage when drilling fluid is flowing through the drill string to generate the pressure pulse in the drilling fluid, wherein the oscillatory manner is an oscillation of the at least one obstructing element between the first blocking angle position and the second blocking angle position such that at the first and second blocking angle position a direction of rotation of the rotor is changed, and wherein the rotational velocity of the at least one obstructing element at the middle position is larger than the rotational velocity of the at least one obstructing element at the first blocking angle position or the second blocking angle position.

2. The method of claim 1, wherein the rotation of the at least one obstructing element from the first blocking angle position to the second blocking angle position includes passing through the middle position.

3. The method of claim 1, wherein a maximum rotational velocity of the rotor is reached at the middle position.

4. The method of claim 1, further comprising biasing the rotor to maintain the at least one obstructing element in about the middle position such that the at least one stator flow passage is open for passage of the drilling fluid.

5. The method of claim 1, wherein the at least one obstructing element comprises a chamfered sidewall.

6. The method of claim 1, further comprising transmitting downhole information from the pulser assembly using at least one of Amplitude Shift Keying (ASK), Frequency Shift Keying (FSK), Pulse Position Modulation (PPM), Quadrature Phase Shift Keying (QPSK), and Phase Shift Keying (PSK).

7. The method of claim 1, wherein the pressure pulse has a sinusoidal pressure profile.

8. The method of claim 1, further comprising adjusting at least one of a first blocking angle of the first blocking angle position and a second blocking angle of the second blocking angle position to adjust an amplitude of the pressure pulse.

9. The method of claim 1, wherein the pulser assembly comprises a single stator flow passage and a single obstructing element.

10. The method of claim 1, further comprising receiving a downlink that includes operation instructions for driving the rotation of the rotor.

11. The method of claim 1, further comprising a maximum obstruction of the drilling fluid flow through the at least one stator flow passage, wherein the maximum obstruction is achieved when the at least one obstructing element is in each of the first blocking angle position and the second blocking angle position.

12. The method of claim 11, wherein a maximum pressure increase is achieved at the second blocking angle position.

13. A rotary pulser configured to be positioned along a drill string through which a drilling fluid flows, the rotary pulser comprising:

a housing configured to be supported along the drill string;

a stator supported by the housing, the stator having at least one stator flow passage that extends from an upstream end to a downstream end of the stator;

a rotor positioned adjacent the stator, the rotor including at least one obstructing element, the rotor rotatable to selectively obstruct the at least one stator flow passage with the at least one obstructing element;

a motor coupled to the rotor, wherein the motor assembly is operable to rotate the rotor relative to the stator; and a controller configured to drive the motor and rotate the rotor relative to the stator, wherein the controller is configured to drive the rotation of the rotor in an oscillatory manner such that:

a first selective obstruction of the at least one stator flow passage by the at least one obstructing element occurs when the obstructing element is rotated from a middle position to a first blocking angle position, wherein the middle position is defined by a minimum of obstruction by the obstructing element of the drilling fluid flow through the at least one stator flow passage, a second selective obstruction of the at least one stator flow passage by the at least one obstructing element occurs when the obstructing element is rotated from the first blocking angle position to a second blocking angle position, wherein the rotation of the obstructing element occurs at a rotational velocity and selectively obstructs the at least one stator flow passage when the drilling fluid is flowing through the drill string to generate a pressure pulse in the drilling fluid, wherein the oscillatory manner is an oscillation of the at least one obstructing element between the first blocking angle position and the second blocking angle position such that at the first and second blocking angle position a direction of rotation of the rotor is changed, and wherein the rotational velocity of the at least one obstructing element at the middle position is larger than the rotational velocity of the at least one obstructing element at the first blocking angle position or the second blocking angle position.

14. The rotary pulser of claim 13, wherein the at least one obstructing element comprises a chamfered sidewall.

15. The rotary pulser of claim 13, further comprising a rotor shaft operably connecting the motor to the rotor.

16. The rotary pulser of claim 13, wherein the pressure pulse has a sinusoidal pressure profile.

17. The rotary pulser of claim 13, wherein the controller is configured to adjust at least one of a first blocking angle of the first blocking angle position and a second blocking angle of the second blocking angle position to adjust an amplitude of the pressure pulse.

18. The rotary pulser of claim 13, wherein the stator comprises a single stator flow passage and the rotor comprises a single obstructing element.

19. The rotary pulser of claim 13, further comprising at least one pressure sensor arranged to monitor a pressure of the pressure pulse.

20. The rotary pulser of claim 13, comprising four stator flow passages and four rotor flow passages.

21. The rotary pulser of claim 13, further comprising a maximum obstruction of the drilling fluid flow through the at least one stator flow passage, wherein the maximum obstruction is achieved when the at least one obstructing element is in each of the first blocking angle position and the second blocking angle position.

22. The rotary pulser of claim 21, wherein a maximum pressure increase is achieved at the second blocking angle position.

23. The rotary pulser of claim 13, wherein a maximum rotational velocity of the rotor is reached at the middle position.

24. The rotary pulser of claim 13, further comprising a biasing element configured to maintain the at least one obstructing element in about the middle position such that the at least one stator flow passage is open for passage of the drilling fluid.

* * * * *